US011427003B2

(12) United States Patent
Maruta et al.

(10) Patent No.: US 11,427,003 B2
(45) Date of Patent: Aug. 30, 2022

(54) INKJET RECORDING APPARATUS FOR RECORDING IMAGES BY EJECTING INK ON RECORDING MEDIA

(71) Applicant: KYOCERA Document Solutions Inc., Osaka (JP)

(72) Inventors: Masaaki Maruta, Osaka (JP); Tomoya Hotani, Osaka (JP); Yuki Tamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/067,706

(22) Filed: Oct. 11, 2020

(65) Prior Publication Data

US 2021/0107283 A1 Apr. 15, 2021

(30) Foreign Application Priority Data

Oct. 11, 2019 (JP) ..... JP2019-188137

(51) Int. Cl.
*B41J 2/165* (2006.01)
*B41J 11/00* (2006.01)

(52) U.S. Cl.
CPC ..... *B41J 2/1652* (2013.01); *B41J 11/007* (2013.01)

(58) Field of Classification Search
CPC ..... B41J 2/1652; B41J 2/16526; B41J 11/007
See application file for complete search history.

(56) References Cited

U.S. PATENT DOCUMENTS 7,198,350 B2 * 4/2007 Nakashima ..... B41J 2/16526 347/23
8,382,241 B2 * 2/2013 Saitoh ..... B41J 2/16526 347/35
2006/0023049 A1 2/2006 Koike
(Continued)

FOREIGN PATENT DOCUMENTS

EP 1666259 A2 6/2006
JP 2006-021399 A 1/2006
(Continued)

OTHER PUBLICATIONS

European Patent Office. Extended European Search Report of foreign counterpart. dated Mar. 10, 2021.

*Primary Examiner* — Sharon Polk
(74) *Attorney, Agent, or Firm* — Hawaii Patent Services; Nathaniel K. Fedde; Kenton N. Fedde

(57) ABSTRACT

Provided is an inkjet recording apparatus that reduces clogging of nozzles, while at the same time avoid a decrease in productivity of the recording medium, and reduces situations in which the recording medium becomes stained due to the staining of opening portions and splashing due to ink ejected during flushing. A conveyor belt of the inkjet recording apparatus has a plurality of opening portion groups. The control unit determines the pattern of the plurality of opening portion groups used for flushing in one cycle of the conveyor belt according to the size of the recording medium. The control unit causes the recording medium to be supplied from the recording medium supply unit between the plurality of opening groups arranged in the conveying direction in the above pattern on the conveying belt and at positions separated from the opening portion groups by a specific distance or more.

12 Claims, 17 Drawing Sheets

(56) References Cited

U.S. PATENT DOCUMENTS

| | | | |
|---|---|---|---|
| 2010/0091056 | A1 | 4/2010 | Miyagi et al. |
| 2010/0149242 | A1 | 6/2010 | Takahashi et al. |
| 2011/0063353 | A1 | 3/2011 | Takeuchi et al. |
| 2011/0227980 | A1 | 9/2011 | Saitoh et al. |

FOREIGN PATENT DOCUMENTS

| | | | |
|---|---|---|---|
| JP | 2008-179167 | A | 8/2008 |
| JP | 2011-079293 | A | 4/2011 |
| JP | 2011-189717 | A | 9/2011 |

* cited by examiner

INKJET RECORDING APPARATUS FOR RECORDING IMAGES BY EJECTING INK ON RECORDING MEDIA

INCORPORATION BY REFERENCE

This application is based on and claims the benefit of priority from Japanese Patent Application No. 2019-188137 filed on Oct. 11, 2019, the contents of which are hereby incorporated by reference.

BACKGROUND

The present disclosure relates to an inkjet recording apparatus that records an image by ejecting ink onto a recording medium.

Conventionally, in an inkjet recording apparatus such as an inkjet printer and the like, flushing (idle ejection) for ejecting ink from the nozzles is regularly performed in order to reduce or prevent clogging of the nozzles due to drying of the ink. For example, in an inkjet recording apparatus of a typical technique, an opening portion is provided in a conveyor belt, and a recording medium is placed on the conveyor belt so as not to cover the opening portion and conveyed. Then, when the opening portion reaches a position facing the recording head due to the running of the conveyor belt ink is ejected from the nozzles of the recording head to perform flushing. An ink absorber such as a sponge or the like is arranged on the side opposite to the recording head (inner peripheral surface side) with respect to the conveyor belt, and ink that is ejected from the recording head and passed through the opening portion during flushing is absorbed by the ink absorber.

Moreover, for example, in an inkjet recording apparatus of a typical technique, a plurality of opening portions are provided in the conveyor belt in the conveying direction of the recording medium, and in a case where the size of the recording medium is large, the conveying speed of the recording medium is slowed to perform flushing. By decreasing the conveying speed of the recording medium, the number of rows in the conveying direction of the opening portions located between the recording media on the conveyor belt increases, so ejection defects may be reduced by increasing the ink ejection amount required for flushing. Furthermore, in a typical technique, the position of the opening portions is recognized based on the detection result of a mark provided on the conveyor belt, and the ejection of ink in flushing is controlled to take into account deformation such as elongation of the conveyor belt and the like, whereby ink is more accurately passed through the opening portions.

SUMMARY

In order to achieve the object described above, an inkjet recording apparatus according to one aspect of the present disclosure includes a recording head and an endless conveyor belt. The recording head has a plurality of nozzles for ejecting ink. The endless conveyor belt conveys a recording medium to a position facing the recording head. In addition to this, the inkjet recording apparatus includes a recording medium supply unit and a control unit. The recording medium supply unit supplies the recording medium to the conveyor belt. The control unit, together with causing the recording head to execute flushing for ejecting the ink at a timing different from timing that contributes to image formation on the recording medium, controls supply of the recording medium to the conveyor belt by the recording medium supply unit. The conveyor belt has a plurality of opening portion groups in which opening portions are arranged in a belt width direction perpendicular to the conveying direction of the recording medium. The opening portions allow ink ejected from each of the nozzles of the recording head to pass during the flushing. The control unit determines the pattern of the plurality of the opening portion groups used for the flushing in one cycle of the conveyor belt according to the size of the recording medium. In addition, the control unit causes the recording medium to be supplied from the recording medium supply unit between the plurality of opening groups arranged in the conveying direction in the pattern on the conveyor belt and at positions separated from the opening portion groups by a specific distance or more.

DETAILED DESCRIPTION

[1. Configuration of an Inkjet Recording Apparatus]

Figure 1:
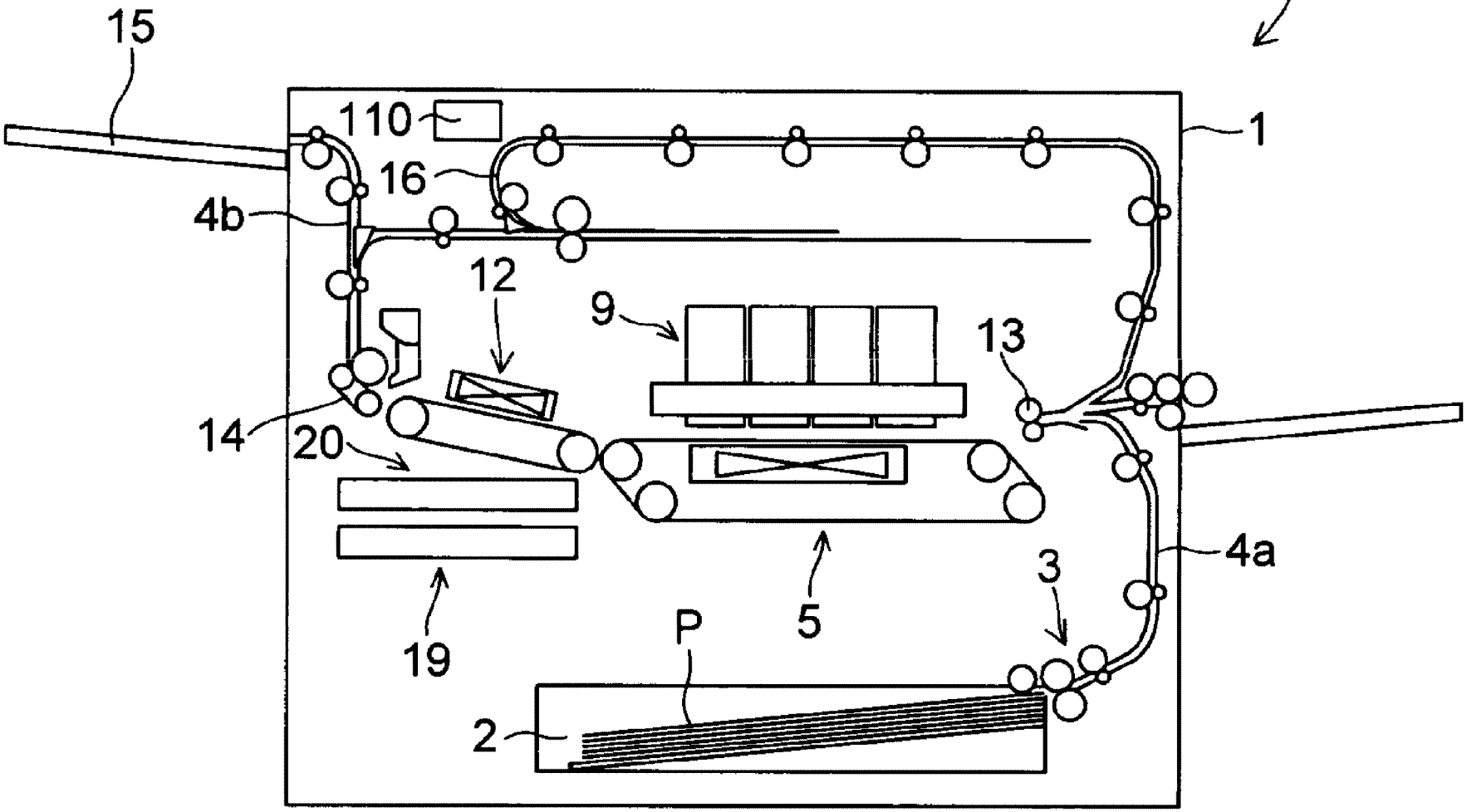
FIG. 1 is an explanatory diagram illustrating a schematic configuration of a printer as an inkjet recording apparatus according to an embodiment of the present disclosure.

Hereinafter, embodiments of the present disclosure will be described with reference to the drawings. FIG. 1 is an explanatory diagram illustrating a schematic configuration of a printer 100 as an inkjet recording apparatus according to an embodiment of the present disclosure. The printer 100 includes a paper feed cassette 2 that is a paper storage unit. The paper feed cassette 2 is arranged at the lower inner portion of the printer body 1. Paper P, which is an example of a recording medium, is housed inside the paper feed cassette 2.

A paper feeding device 3 is arranged on the downstream side in the paper conveying direction of the paper feed cassette 2, tor in other words, above the right side of the paper feed cassette 2 in FIG. 1. By this paper feeding device 3, paper P is directed toward the upper right of the paper feed cassette 2 in FIG. 1, and is separated and fed out one sheet at a time.

The printer 100 includes a first paper conveying path 4*a* in the inner portion thereof. The first paper conveying path 4*a* is located on the upper right side, which is the paper feed direction, with respect to the paper feed cassette 2. The paper P fed out from the paper feed cassette 2 is conveyed vertically upward along the side surface of the printer body 1 by the first paper conveying path 4*a*.

A registration roller pair 13 is provided at the downstream end of the first paper conveying path 4*a* in the paper conveying direction. Furthermore, a first conveying unit 5 and the recording unit 9 are arranged immediately downstream of the registration roller pair 13 in the paper conveying direction. The paper P fed out from the paper feed cassette 2 reaches the registration roller pair 13 via the first paper conveying path 4*a*. The registration roller pair 13 feeds the paper P toward the first conveying unit 5 while correcting diagonal feeding of the paper P and measuring the timing with the ink ejection operation performed by the recording unit 9.

The paper P fed to the first conveying unit 5 is conveyed to a position facing the recording unit 9 (especially recording heads 17*a* to 17*c* described later) by the first conveyor belt 8 (see FIG. 2). An image is recorded on the paper P by ejecting ink from the recording unit 9 onto the paper P. At this time, the ejection of ink in the recording unit 9 is controlled by the control unit 110 in the inner portion of the printer 100. The control unit 110 includes, for example, a central processing unit (CPU).

The second conveying unit 12 is arranged on the downstream side (left side in FIG. 1) of the first conveying unit 5 in the paper conveying direction. The paper P on which the image is recorded by the recording unit 9 is sent to the second conveying unit 12. The ink ejected onto the surface of the paper P is dried while passing through the second conveying unit 12.

A decurler unit 14 is provided on the downstream side of the second conveying unit 12 in the paper conveying direction and near the left side surface of the printer body 1. The paper P whose ink has been dried by the second conveying unit 12 is sent to the decurler unit 14 in order to correct curling that has occurred in the paper P.

A second paper conveying path 4*b* is provided on the downstream side (upper side in FIG. 1) of the decurler unit 14 in the paper conveying direction. In a case where double-sided recording is not performed, paper P that has passed through the decurler unit 14 passes through the second paper conveying path 4*b* and is discharged to the paper discharge tray 15 provided in the outer portion of the left side surface of the printer 100.

A reverse conveying path 16 for performing double-sided recording is provided in the upper portion of the printer body 1 above the recording unit 9 and the second conveying unit 12. In a case of performing double-sided recording, the paper P that has passed through the second conveying unit 12 and the decurler unit 14 after recording on one surface (first surface) of the paper P is sent to the reverse conveying path 16 through the second paper conveying path 4*b*.

The conveying direction of the paper P sent to the reverse conveying path 16 is subsequently switched for recording on the other surface (second surface) of the paper P. Then, the paper P passes through the upper portion of the printer body 1 and is sent toward the right side, and is sent again, via the registration roller pair 13, to the first conveying unit 5 with the second surface thereof facing upward. In the first conveying unit 5, the paper P is conveyed to a position facing the recording unit 9, and an image is recorded on the second surface by ejecting ink from the recording unit 9. The paper P after double-sided recording is discharged to the paper discharge tray 15 via the second conveying unit 12, the decurler unit 14, and the second paper conveying path 4*b* in this order.

Moreover, a maintenance unit 19 and a cap unit 20 are arranged below the second conveying unit 12. When executing purging, the maintenance unit 19 moves horizontally below the recording unit 9, wipes the ink extruded from the ink ejection port of the recording head, and collects the wiped ink. Note that purging refers to an operation of forcibly extruding the ink from the ink ejection port of the recording head in order to discharge thickened ink, foreign matter and air bubbles in the ink ejection port. The cap unit 20 moves horizontally below the recording unit 9 when capping the ink ejection surface of the recording head, moves further upward, and is attached to the lower surface of the recording head.

Figure 2:
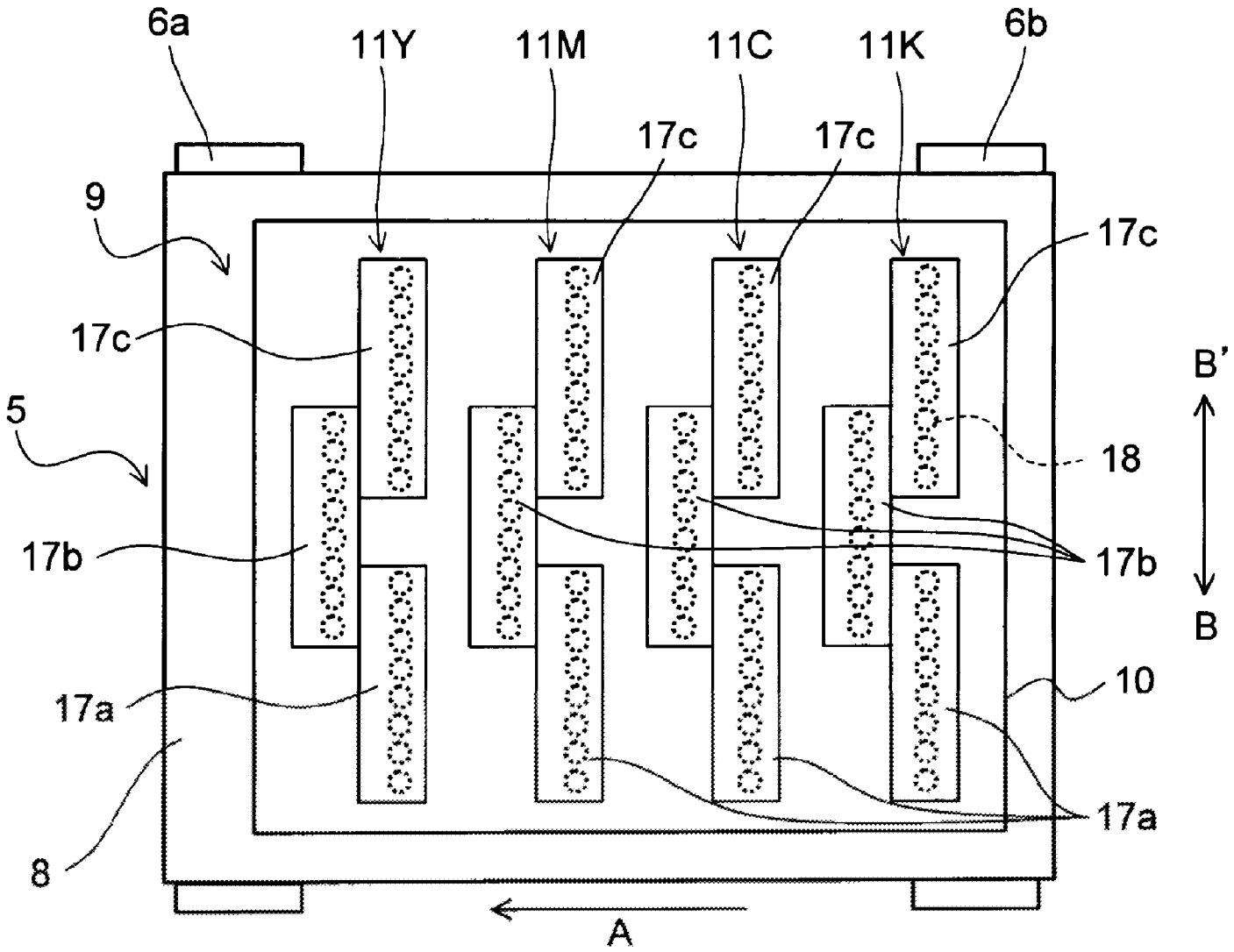
FIG. 2 is a plan view of a recording unit included in the printer.

FIG. 2 is a plan view of the recording unit 9. The recording unit 9 includes a head housing 10 and line heads 11Y, 11M, 11C and 11K. The line heads 11Y to 11K are held in the head housing 10 at a height at which specific spacing (for example, 1 mm) is formed with respect to the conveying surface of an endless first conveyor belt 8 that spans around a plurality of rollers including a drive roller 6*a*, a follower roller 6*b*, and another roller 7.

The line heads 11Y to 11K have a plurality of (here, three) recording heads 17*a* to 17*c*, respectively. The recording heads 17*a* to 17*c* are arranged in a zigzag pattern along the paper width direction (direction of arrow BB') orthogonal to the paper conveying direction (direction of arrow A). The recording heads 17*a* to 17*c* have a plurality of ink ejection ports 18 (nozzles). The ink ejection ports 18 are arranged at equal intervals in the width direction of the recording head, or in other words, the paper width direction (direction of arrow BB'). From the line heads 11Y to 11K, ink of each color of yellow (Y), magenta (M), cyan (C), and black (K) is respectively ejected via the ink ejection ports 18 of the recording heads 17*a* to 17*c* toward the paper P that is conveyed by the first conveyor belt 8.

Figure 3:
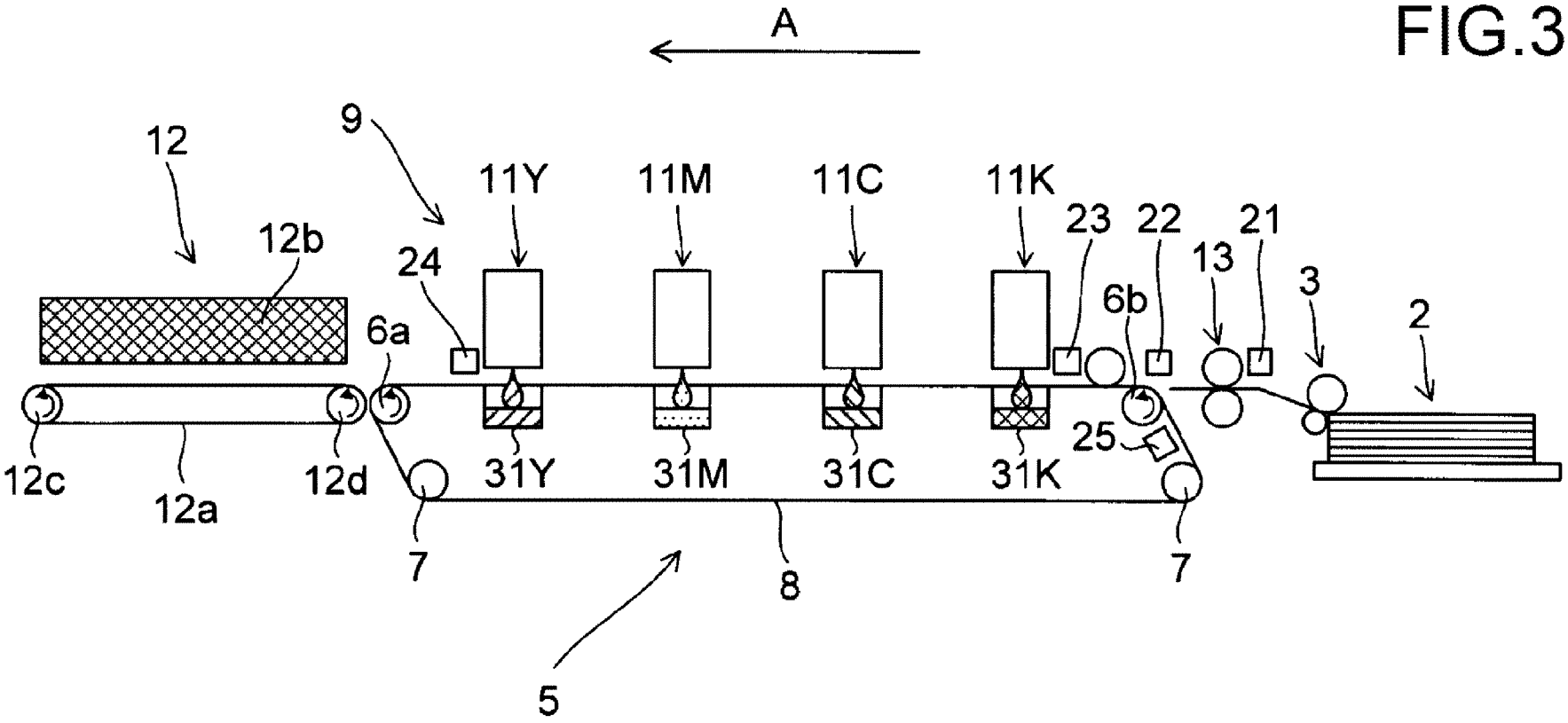
FIG. 3 is an explanatory diagram schematically illustrating the configuration around the paper conveying path from the paper feed cassette of the printer to a second conveying unit via a first conveying unit.
Figure 4:
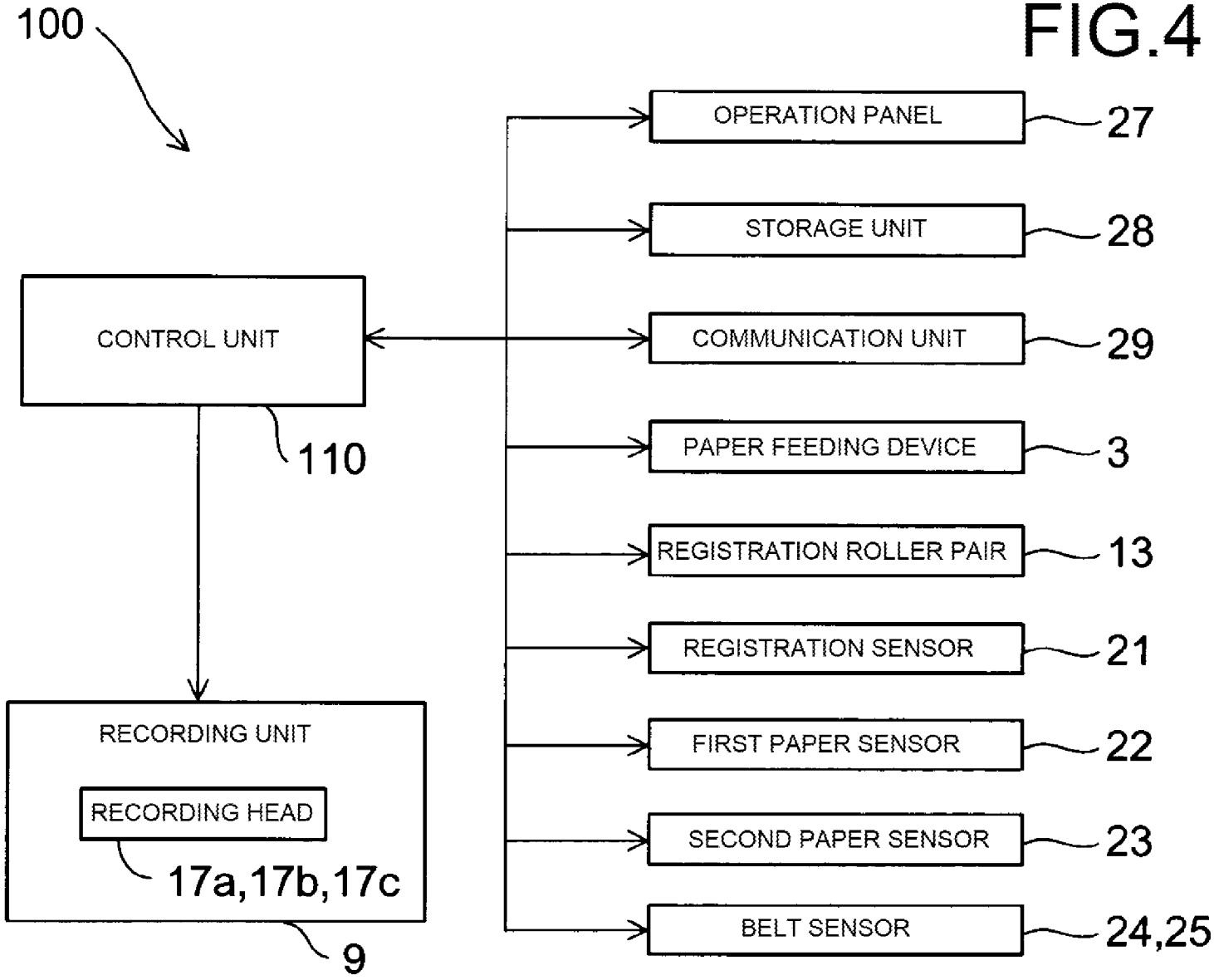
FIG. 4 is a block diagram illustrating a hardware configuration of a main part of the printer.

FIG. 3 schematically illustrates the configuration around the conveying path of the paper P from the paper feed cassette 2 to the second conveying unit 12 via the first conveying unit 5. Moreover, FIG. 4 is a block diagram illustrating a hardware configuration of a main part of the printer 100. The printer 100, in addition to the configuration described above, further includes a registration sensor 21, a first paper sensor 22, a second paper sensor 23, and belt sensors 24 and 25.

The registration sensor 21 detects the paper P conveyed from the paper feed cassette 2 by the paper feeding device 3 and sent to the registration roller pair 13. The control unit 110 is able to control the rotation start timing of the registration roller pair 13 based on the detection result of the registration sensor 21. For example, the control unit 110 is able to control the supply timing of paper P after the skew (inclination) correction by the registration roller pair 13 to the first conveyor belt 8 based on the detection result of the registration sensor 21.

The first paper sensor 22 is a line sensor that detects the position in the width direction of the paper P sent from the registration roller pair 13 to the first conveyor belt 8. Based on the detection result of the first paper sensor 22, the control unit 110 is able to record an image on the paper P by causing ink to be ejected from the ink ejection openings 18 of the ink ejection ports 18 of the recording heads 17*a* to 17*c* of the line heads 11Y to 11K that correspond to the width of the paper P.

The second paper sensor 23 is a sensor for detecting the position in the conveying direction of the paper P conveyed by the first conveyor belt 8. The second paper sensor 23 is located upstream in the paper conveying direction of the recording unit 9 and downstream of the first paper sensor 22. Based on the detection result of the second paper sensor 23, the control unit 110 is able to control the ink ejection timing for the paper P reaching the position facing the line heads 11Y to 11K (recording heads 17*a* to 17*c*) by the first conveyor belt 8.

Belt sensors 24 and 25 detect the positions of a plurality of opening portion groups 82 (see FIG. 8), which will be described later, provided on the first conveyor belt 8. In other words, the belt sensors 24 and 25 are detection sensors that detect the passage of at least one of the opening groups 82 due to the running of the first conveyor belt 8. The belt sensor 24 is located on the downstream side of the recording unit 9 in the paper conveying direction (the running direction of the first conveyor belt 8). The belt sensor 25 is located at position between the follower roller 6*b* and the other roller 7 where the first conveyor belt 8 is stretched around the follower roller 6*b* and the other roller 7. The follower roller 6*b* is located upstream of the recording unit 9 in the running direction of the first conveyor belt 8. Note that the belt sensor 24 also has the same function as the second paper sensor 23. The control unit 110 is able to control the registration roller pair 13 so as to supply paper P to the first conveyor belt 8 at a specific timing based on the detection result of the belt sensor 24 or 25.

Moreover, the positions of the paper are detected by a plurality of sensors (second paper sensor 23, belt sensor 24), and the positions of the opening portion groups 82 of the first conveyor belt 8 are detected by a plurality of sensors (belt sensors 24 and 25), and as a result, it is possible to correct error in the detected positions and detect an abnormality.

The first paper sensor 22, the second paper sensor 23, and the belt sensors 24 and 25 described above may be configured by a transmissive or reflective optical sensor or a CIS sensor (contact image sensor). Moreover, marks corresponding to the position of the opening portion groups 82 are formed at the end portion in the width direction of the first conveyor belt 8, and the belt sensors 24 and 25 detect the marks, whereby the positions of the opening portion groups 82 may be detected.

In addition, the printer 100 may be configured to include a meandering detection sensor that detects the meandering of the first conveyor belt 8 and be configured to correct the meandering of the first conveyor belt 8 based on the detection result.

In addition, the printer 100 further includes an operation panel 27, a storage unit 28, and a communication unit 29. The operation panel 27 is an operation unit for receiving various setting input from the user. For example, the user may operate the operation panel 27 to input information about the size of the paper P set in the paper feed cassette 2, or in other words, the size of the paper P conveyed by the first conveyor belt 8. The storage unit 28 is a memory that stores an operation program of the control unit 110 and also stores various types of information, and includes a ROM (Read Only Memory), a RAM (Random Access Memory), a non-volatile memory, and the like. Information set by the operation panel 27 (for example, information about the size of the paper P) is stored in the storage unit 28. The communication unit 29 is a communication interface (for example, a personal computer (PC)) for transmitting and receiving information to and from the outside. For example, when the user operates the PC and transmits a print command together with image data to the printer 100, the image data and the print command are inputted to the printer 100 via the communication unit 29. In the printer 100, an image may be recorded on the paper P by the control unit 110 controlling the recording heads 17*a* to 17*c* to eject ink based on the image data.

Moreover, as illustrated in FIG. 3, the printer 100 has ink receiving units 31Y, 31M, 31C and 31K on the inner peripheral surface side of the first conveyor belt 8. When the recording heads 17*a* to 17*c* are made to execute flushing, the ink receiving units 31Y to 31K receive and collect the ink that has been ejected from the recording heads 17*a* to 17*c* and passed through the opening portions 80 of an opening portion groups 82 of the first conveyor belt 8 described later (see FIG. 8). Therefore, the ink receiving units 31Y to 31K are provided at positions facing the recording heads 17*a* to 17*c* of the line heads 11Y to 11K via the first conveyor belt 8. Note that the ink collected by the ink receiving units 31Y to 31K is sent to, for example, a waste ink tank and disposed of, however, may also be reused without being disposed of.

Here, flushing is the ejection of ink at a timing different from the timing that contributes to image formation (image recording) on the paper P, and is for the purpose of reducing or preventing clogging of the ink ejection ports 18 due to ink drying. The execution of flushing in the recording heads 17*a* to 17*c* is controlled by the control unit 110.

The second conveying unit 12 described above is configured to include a second conveyor belt 12*a* and a dryer 12*b*. The second conveyor belt 12*a* is stretched around two drive rollers 12*c* and a follower roller 12*d*. The paper P that is conveyed by the first conveying unit 5 and on which an image has been recorded by ink ejected by the recording unit 9 is conveyed by the second conveyor belt 12*a* and dried by the dryer 12*b* while being conveyed to the decurler unit 14 described above.

[2. Details of the First Conveying Unit]

(2-1. Configuration Example of the First Conveying Unit)

In the present embodiment, a negative pressure suction method is adopted as a method for conveying the paper P in the first conveying unit 5. The negative pressure suction method is a method in which the paper P is sucked onto the first conveyor belt 8 by negative pressure suction and conveyed.

Here, as described above, the ink receiving units 31Y to 31K are provided at positions facing the recording heads 17*a* to 17*c* of the line heads 11Y to 11K via the first conveyor belt 8. During negative pressure suction, in a case where the suction force of the area where the ink receiving units 31Y to 31K are provided is strong, the ink ejected from the recording heads 17*a* to 17*c* at the time of flushing vigorously passes through the opening portions 80 of the first conveyor belt 8. Then, the ink may collide with the liquid surface of ink already collected in the ink receiving unit 31Y to 31K, scattering ink into the surroundings and causing a mist to occur. In a case where a mist occurs, the scattered ink adheres to the inner peripheral surface of the first conveyor belt 8 and stains the inner peripheral surface. As a result, the surface of the rollers around which the first conveyor belt 8 is stretched may be stained, and uneven transportation of the first conveyor belt 8 (for example, meandering or slipping) may occur.

Figure 5:
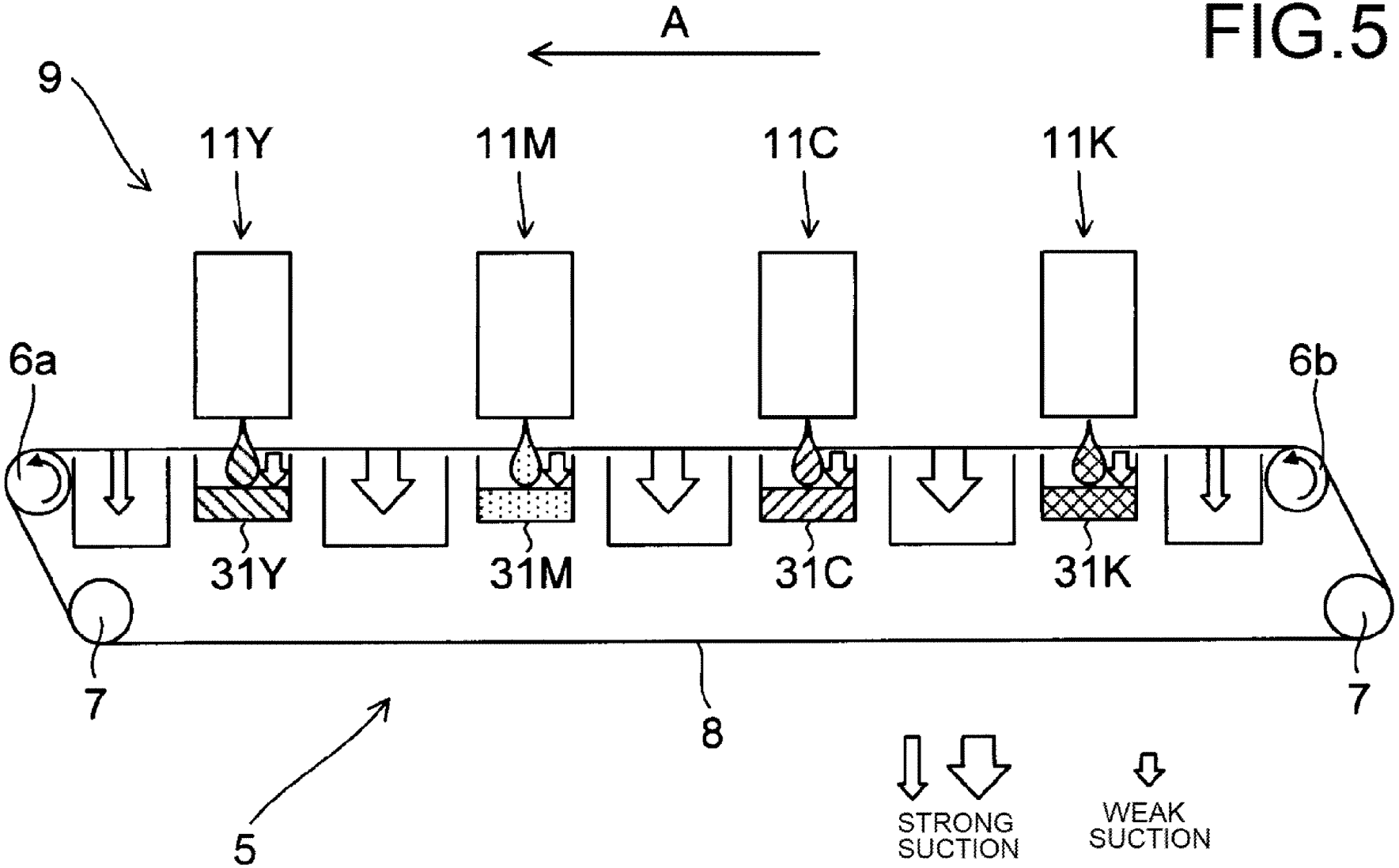
FIG. 5 is explanatory diagram schematically illustrating an area in the first conveying unit where suction force differs.

Therefore, in the present embodiment, as illustrated in FIG. 5, the suction force of the areas where the ink receiving units 31Y to 31K are provided, or in other words, the areas facing the line heads 11Y to 11K via the first conveyor belt 8 is made to be weaker than the upstream and downstream areas in the paper conveying direction. This reduces the above-mentioned inconvenience caused by the mist. More specifically, with the following configuration, areas with different suction forces are generated.

Figure 6:
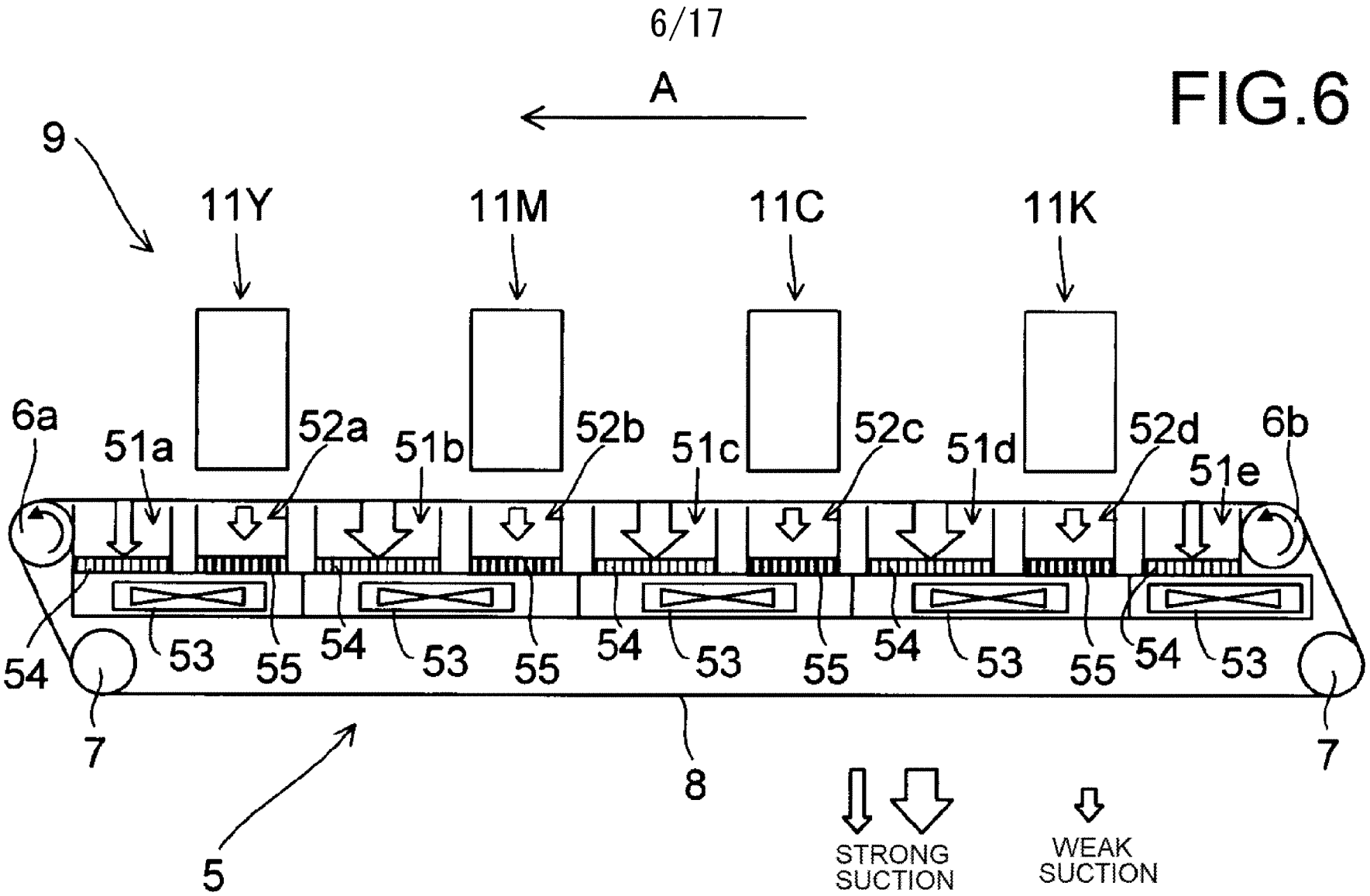
FIG. 6 is an explanatory diagram schematically illustrating a configuration example of the first conveying unit.

FIG. 6 is an explanatory diagram schematically illustrating a configuration example of the first conveying unit 5. First suction chambers 51*a* to 51*e* and second suction chambers 52*a* to 52*d* are provided on the inner peripheral surface side of the first conveyor belt 8 of the first conveying unit 5. The first suction chambers 51*a* to 51*e* and the second suction chambers 52*a* to 52*d* are formed in an elongated shape in the belt width direction of the first conveyor belt 8. The first suction chambers 51*a* to 51*e* and the second suction chambers 52*a* to 52*d* are open on the side facing the first conveyor belt 8.

The first suction chambers 51*a* to 51*e* are provided in this order from the downstream side to the upstream side in the paper conveying direction (direction A). The second suction chamber 52*a* is provided between the first suction chamber 51*a* and the first suction chamber 51*b* at a position facing the line head 11Y via the first conveyor belt 8. The second suction chamber 52*b* is provided between the first suction chamber 51*b* and the first suction chamber 51*c* at a position facing the line head 11M via the first conveyor belt 8. The second suction chamber 52*c* is provided between the first suction chamber 51*c* and the first suction chamber 51*d* at a position facing the line head 11C via the first conveyor belt 8. The second suction chamber 52*d* is provided between the first suction chamber 51*d* and the first suction chamber 51*e* at a position facing the line head 11K via the first conveyor belt 8. The ink receiving units 31Y to 31K described above are arranged in the second suction chambers 52*a* to 52*d*, respectively.

The inner portions of the first suction chambers 51*a* to 51*e* and the second suction chambers 52*a* to 52*d* are sucked by suction members 53. The suction member 53 sucks the paper P onto the first conveyor belt 8 by negative pressure suction. This kind of a suction member 53 is composed of, for example, a fan or a compressor. In the present embodiment, the inner portions of the first suction chamber 51*a* and the second suction chamber 52*a* are sucked by a common suction member 53. Moreover, the inner portions of the first suction chamber 51*b* and the second suction chamber 52*b* are sucked by a common suction member 53. Similarly, the inner portions of the first suction chamber 51*c* and the second suction chamber 52*c* are sucked by a common suction member 53, and the inner portions of the first suction chamber 51*d* and the second suction chamber 52*d* are sucked by a common suction member 53. The first suction chamber 51*e* is sucked alone by a suction member 53.

A filter 54 is arranged in each of the first suction chambers 51*a* to 51*e*, and a filter 55 is arranged in each of the second suction chambers 52*a* to 52*d*. Therefore, when each suction member 53 is driven, the inside of the first suction chambers 51*a* to 51*e* is sucked through the filter 54, and the inside of the second suction chambers 52*a* to 52*d* is sucked through the filter 55. As a result, the inner portions of the first suction chambers 51*a* to 51*e* and the second suction chambers 52*a* to 52*d* have a negative pressure, and air is sucked via the suction holes 8*a* that will be described later (see FIG. 8) or the opening portion groups 82 provided on the first conveyor belt 8, and the paper P is conveyed while being sucked to the first conveyor belt 8.

Here, the filter 54 is configured of a coarser mesh than the filter 55. Therefore, the resistance to the air passing through the filter 54 is lower than the resistance of the air passing through the filter 55. Therefore, in a case where each suction member 53 is driven by the same driving force, the inner portions of the first suction chambers 51*a* to 51*e* are sucked with a relatively strong suction force, and the inner portions of the second suction chambers 52*a* to 52*d* are sucked with a relatively weak suction force. As a result, the speed at which the ink ejected from the recording heads 17*a* to 17*c* during flushing passes through the opening portions 80 of the first conveyor belt 8 is suppressed, and scattering of ink (mist) due to collision with the liquid surface of ink accumulated in the ink receiving units 31Y to 31K may be reduced. This makes it possible to reduce the above-mentioned inconvenience caused by the mist.

(2-2. Other Configuration Example of the First Conveying Unit)

Figure 7:
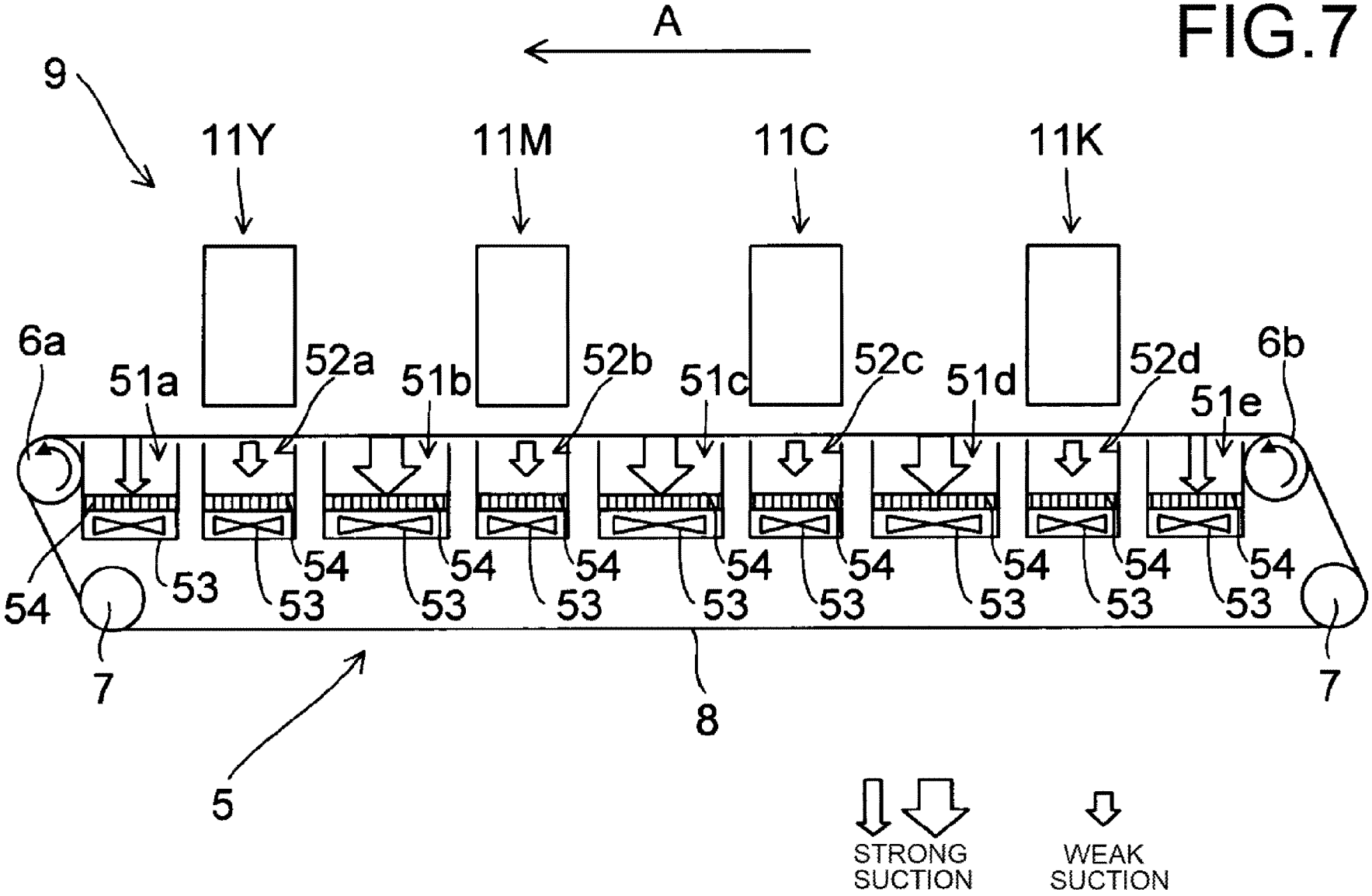
FIG. 7 is an explanatory diagram schematically illustrating another configuration example of the first conveying unit.

FIG. 7 is an explanatory diagram schematically illustrating another configuration example of the first conveying unit 5. In the first conveying unit 5 of FIG. 7, identical filters 54 are arranged in the first suction chambers 51*a* to 51*e* and the second suction chambers 52*a* to 52*d* illustrated in FIG. 6, and each of the first suction chambers 51*a* to 51*e* and the second suction chambers 52*a* to 52*d* is configured to be sucked by a different suction member 53. In such a configuration, by switching the driving force of each suction member 53 that sucks the inner portions of the second suction chambers 52*a* to 52*d*, the suction force of the second suction chambers 52*a* to 52*d* is switched between strong suction and weak suction. Note that the driving of each suction member 53 is controlled by the control unit 110, for example.

For example, when ink is ejected onto the paper P conveyed by the first conveyor belt 8 (at the time of recording an image), all of the suction members 53 that suck the first suction chambers 51*a* to 51*e* and the second suction chambers 52*a* to 52*d* are driven by a first driving force. On the other hand, at the time of flushing, each suction member 53 that sucks the first suction chambers 51*a* to 51*e* is driven by the first driving force, and each suction member 53 that sucks the second suction chambers 52*a* to 52*d* is driven by a second driving force that is lower than the first driving force. As a result, at the time of recording an image, the first suction chambers 51*a* to 51*e* and the second suction chambers 52*a* to 52*d* are strongly sucked to convey the paper P, and at the time of flushing, only the second suction chambers 52*a* to 52*d* are weakly sucked, making it possible to reduce mist. This makes it possible to reduce the above-mentioned inconvenience caused by the mist.

In addition, instead of using the filters 54 or 55, the diameters (flow passage cross-sectional areas) of the pipes that are the flow passages of the air sucked from the first suction chambers 51*a* to 51*e* and the second suction chambers 52*a* to 52*d* are made different. In doing so, the suction force may be made different between the first suction chambers 51*a* to 51*e* and the second suction chambers 52*a* to 52*d*.

[3. Details of the First Conveyor Belt]

(3-1. Configuration Example of the First Conveyor Belt)

Figure 8:
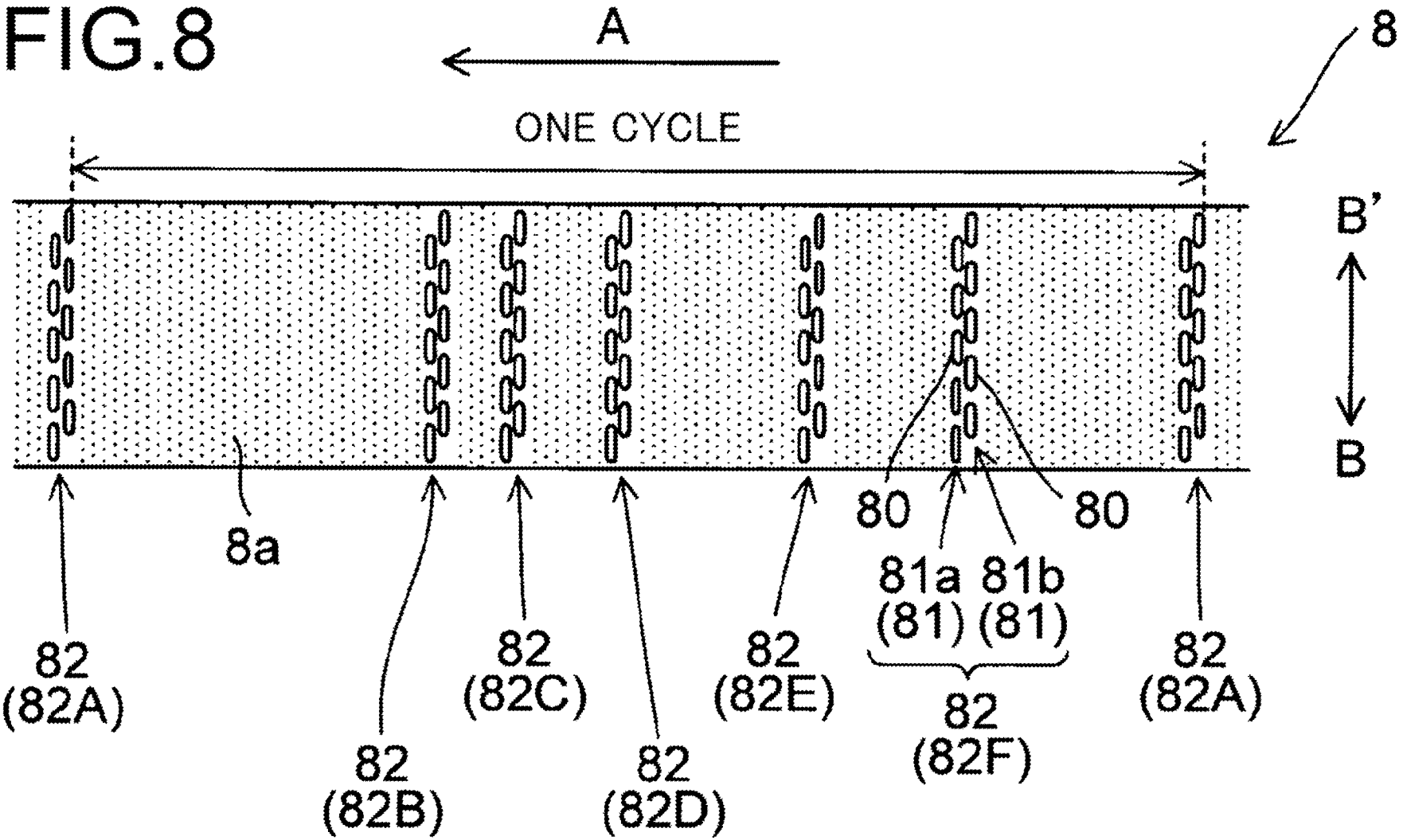
FIG. 8 is a plan view illustrating a configuration example of a first conveyor belt of the first conveying unit.

Next, details of the first conveyor belt 8 of the first conveying unit 5 will be described. FIG. 8 is a plan view illustrating a configuration example of the first conveyor belt 8. In the present embodiment, as described above, paper P is conveyed by the negative pressure suction method. In order for this, as illustrated in FIG. 8, the first conveyor belt 8 is provided with innumerable suction holes 8*a* through which suction air generated by negative pressure suction of the suction member 53 passes.

Moreover, the first conveyor belt 8 is also provided with opening portion groups 82. The opening portion groups 82 are sets of opening portions 80 through which ink ejected from each nozzle (ink ejection ports 18) of the recording heads 17*a* to 17*c* passes during flushing. The opening area of each of the opening portions 80 is larger than the opening area of each of the above-mentioned suction holes 8*a*. The first conveyor belt 8 has a plurality of opening portion groups 82 in one cycle in the conveying direction (direction A) of the paper P, and in the present embodiment there is six. Note that when distinguishing the opening portion groups 82 from each other, the six opening portion groups 82 are referred to as opening portion groups 82A to 82F from the downstream side in the A direction. The above-mentioned suction holes 8*a* are located between an opening portion group 82 and opening portion group 82 that are adjacent to each other in the A direction. In other words, in the first conveyor belt 8, the suction holes 8*a* are not formed in a region that overlaps an opening portion group 82.

The opening portion groups 82 are irregularly positioned in the A direction in one cycle of the first conveyor belt 8. In other words, in the A direction, the interval between an opening portion group 82 and the adjacent opening group 82 is not constant but changes (there are at least two types of the above-mentioned intervals). In this case, the maximum interval between two adjacent opening portion groups 82 in the A direction (for example, the distance between the opening portion group 82A and the opening portion group 82B in FIG. 8) is longer than the length in the A direction of the paper P when the minimum printable size (for example, A4 size horizontal placement)) paper P is placed on the first conveyor belt 8.

The opening portion groups 82 have opening portion rows 81. The opening portion rows 81 are configured by arranging a plurality of opening portions 80 in the belt width direction (paper width direction, BB' direction) orthogonal to the A direction. One opening portion group 82 has a plurality of opening portion rows 81 in the A direction, and in the present embodiment, has two opening portion rows 81. Note that when distinguishing the two opening portion rows 81 from each other, one is opening portion row 81*a* and the other is opening portion row 81*b*.

In one opening group 82, the opening portions 80 of any one of the opening portion rows 81 (for example, the opening portion row 81*a*) are positioned offset in the BB' direction with respect to the opening portions 80 of the other opening row 81 (for example, the opening row 81*b*). Furthermore, the opening portions 80 are positioned so as to overlap a part of the opening portions 80 of the other opening portion row 81 (for example, the opening row 81*b*) when viewed in the A direction. In addition, in each opening portion row 81, the plurality of opening portions 80 are located at equal intervals in the BB' direction.

As described above, by arranging the plurality of opening portion rows 81 in the A direction to form one opening portion group 82, the width of the opening portion group 82 in the BB' direction is larger than the width of the recording heads 17*a* to 17*c* in the BB' direction. Therefore, the opening portion groups 82 cover all the ink ejection areas of the recording heads 17*a* to 17*c* in the BB' direction, and the ink ejected from all the ink ejection ports 18 of the recording heads 17*a* to 17*c* during flushing passes through the opening portions 80 of one of the opening portion groups 82.

(3-2. Opening Portion Group Pattern Used During Flushing)

In the present embodiment, the control unit 110 records an image on paper P by driving the recording heads 17*a* to 17*c* based on image data transmitted from the outside (for example, a PC) while paper P is conveyed using the first conveyor belt 8 described above. At this time, by causing the recording heads 17*a* to 17*c* to perform flushing (inter-paper flushing) between the conveyed paper P and paper P, clogging of the ink ejection ports 18 is reduced or prevented.

Here, in the present embodiment, the control unit 110 sets the pattern (combination) in the A direction of the plurality of opening portion groups 82 used during flushing according to the size of the paper P to be used in one cycle of the first conveyor belt 8. Note that the size of the paper P to be used may be recognized by the control unit 110 based on information stored in the storage unit 28 (size information about the paper P inputted using the operation panel 27).

Figure 9:
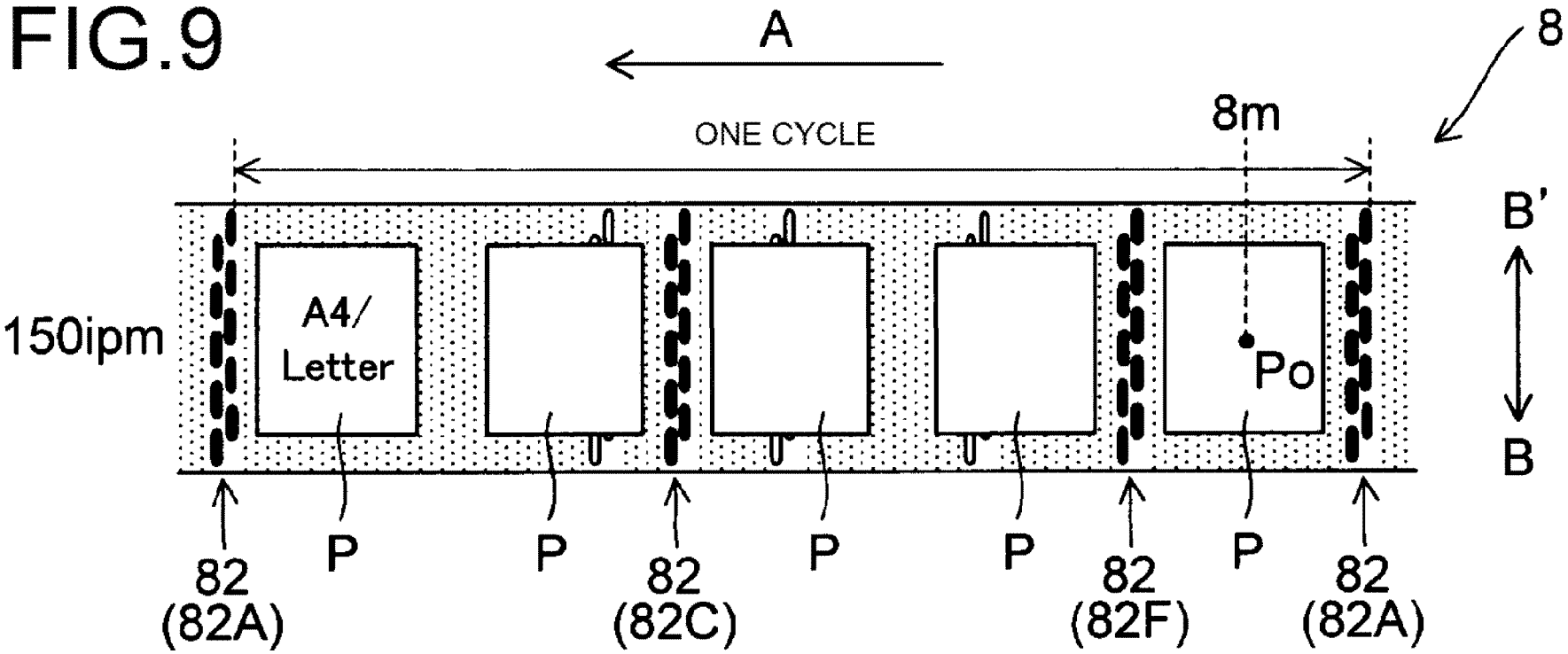
FIG. 9 is an explanatory diagram schematically illustrating an example of a pattern of a group of opening portions for flushing when the first conveyor belt of FIG. 8 is used, and illustrates paper arranged on the first conveyor belt according to the pattern.
Figure 10:
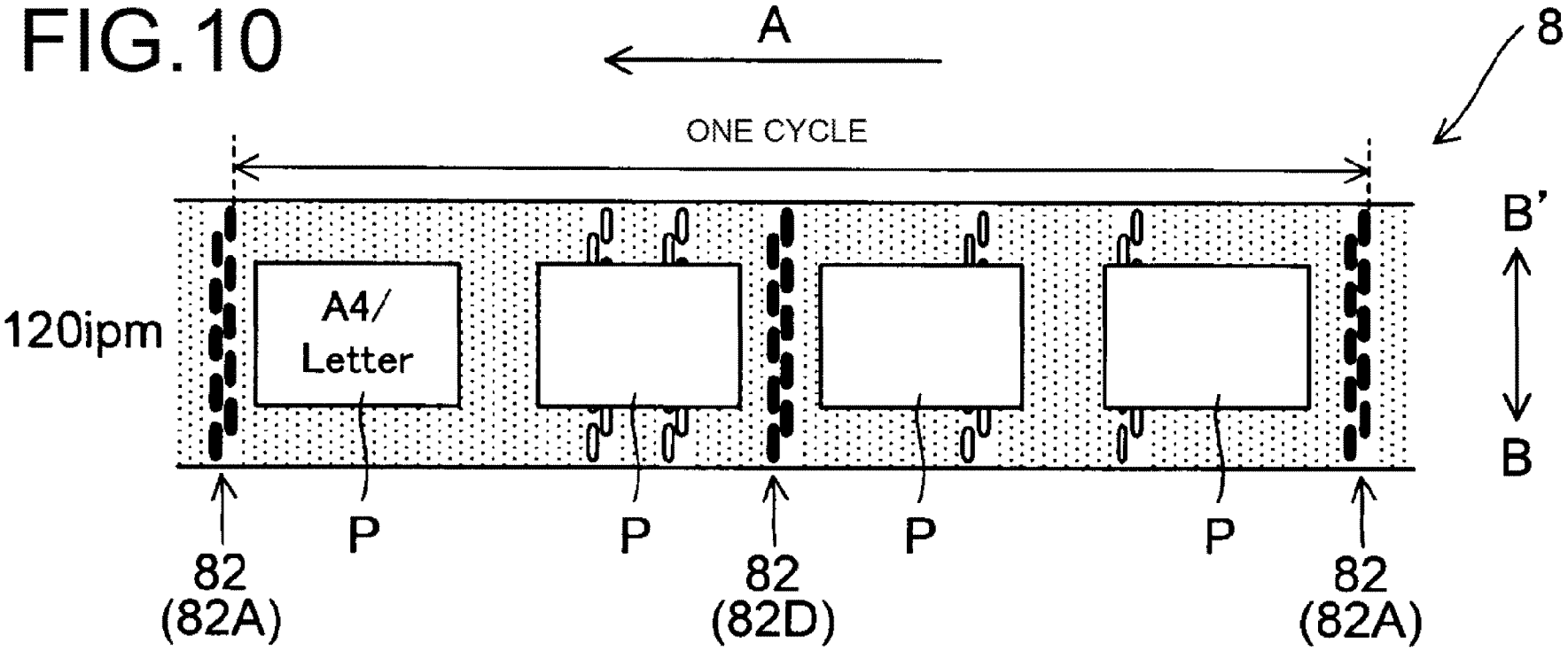
FIG. 10 is an explanatory diagram schematically illustrating another example of the pattern and paper arranged on the first conveyor belt according to the pattern.
Figure 11:
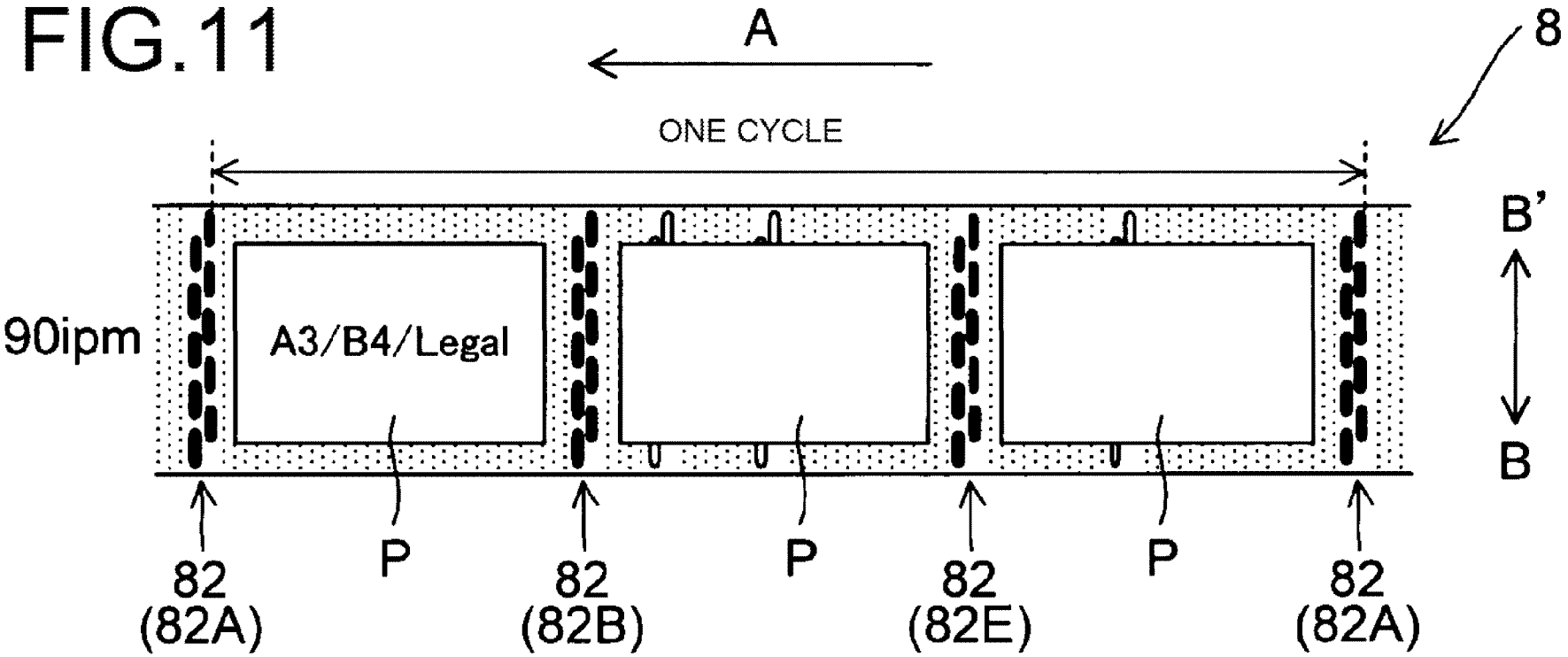
FIG. 11 is an explanatory diagram schematically illustrating yet another example of the pattern and paper arranged on the first conveyor belt according to the pattern.
Figure 12:
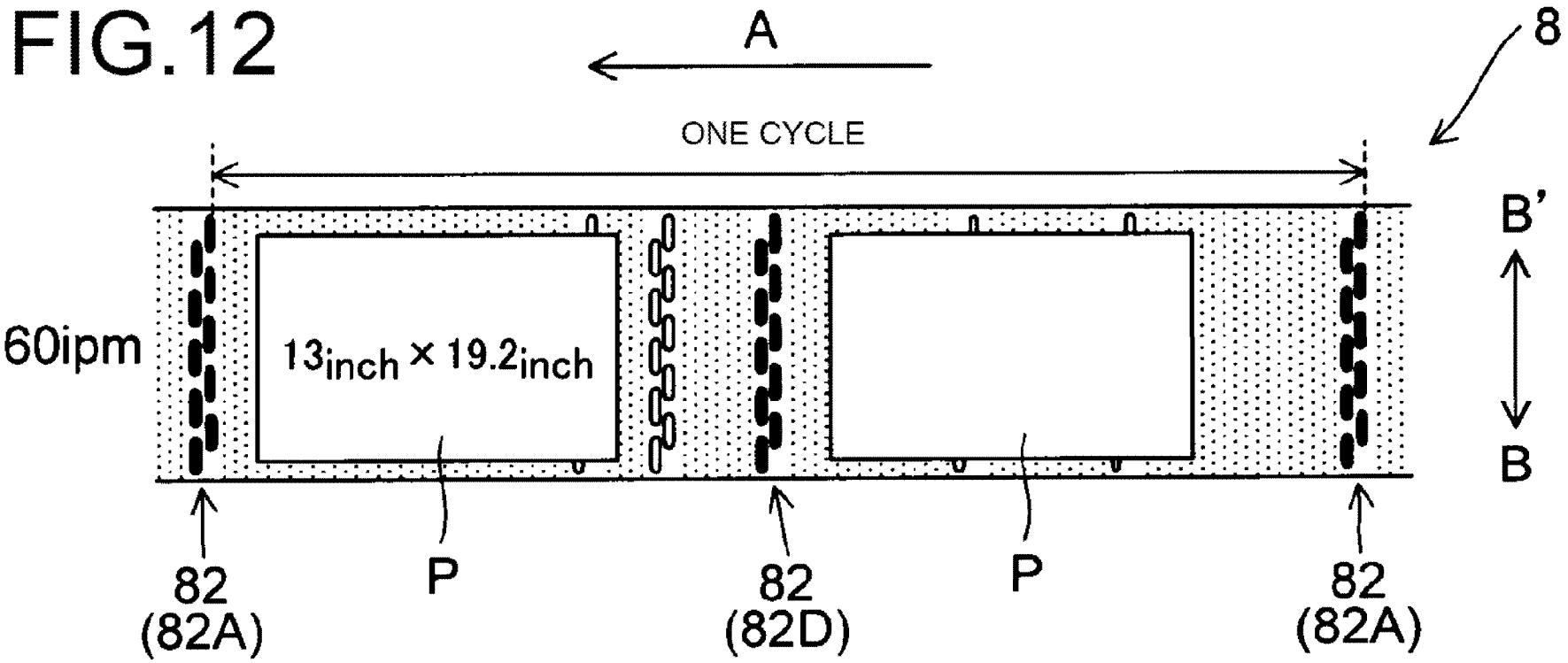
FIG. 12 is an explanatory diagram schematically illustrating yet another example of the pattern and paper arranged on the first conveyor belt according to the pattern.

FIGS. 9 to 12 each illustrates an example of the above patterns for each kind of paper P. For example, in a case where the paper P to be used is A4 size (horizontal placement) or letter size (horizontal placement), the control unit 110 selects the pattern of the opening portion groups 82 illustrated in FIG. 9. In other words, the control unit 110 selects the opening portion groups 82A, 82C, 82F from among the six opening portion groups 82 illustrated in FIG. 8 as the opening portion groups 82 to be used during flushing. In a case where the paper P to be used is A4 size (vertical placement) or letter size (vertical placement), the control unit 110, as illustrated in FIG. 10, selects the opening portion groups 82A, 82D, from among the six opening portion groups 82 as the opening portion groups 82 to be used for flushing. In a case where the paper P to be used is A3 size, B4 size, or legal size (all vertically placed), the control unit 110, as illustrated in FIG. 11, selects the opening portion groups 82A, 82B, 82E from among the six opening groups 82 as the opening portion groups 82 to be used during flushing. In a case where the paper P to be used is size 13 inches×19.2 inches, the control unit 110, as illustrated in FIG. 12, selects the opening portion groups 82A, 82D from among the six opening groups 82 as the opening portion groups 82 to be used during flushing. Note that in each of the figures, the opening portions 80 of the opening portion groups 82 belonging to the above patterns are illustrated in black for convenience.

Then, the control unit 110, by the running of the first conveyor belt 8, causes the recording heads 17*a* to 17*c* to execute flushing at the timing when the opening portion groups 82 positioned in the determined pattern face the recording heads 17*a* to 17*c*. Here, the running speed of the first conveyor belt 8 (paper conveying speed), the spacing between the opening portion groups 82A to 82E, and the positions of the recording heads 17*a* to 17*c* with respect to the first conveyor belt 8 are all understandable. Therefore, when the belt sensor 24 or 25 detects that a reference opening portion group 82 (for example, the opening portion group 82A) has passed due to the running of the first conveyor belt 8, it is understood how many seconds after the detection time the opening groups 82A to 82E pass through the positions facing the recording heads 17*a* to 17*c*. Therefore, the control unit 110, based on the detection results of the belt sensor 24 or 25, is able to cause the recording heads 17*a* to 17*c* to execute flushing at timing when the opening portion groups 82 positioned in the determined pattern described above face the recording heads 17*a* to 17*c*.

At this time, the control unit 110, based on the detection result of the belt sensor 24 or 25, controls flushing by the recording heads 17*a* to 17*c* so that the ink passes through the same opening portion group 82 in each cycle of the first conveyor belt 8 for each class determined according to the size of the paper P.

For example, a case (first class) where the size of the paper P used is A4 size (horizontal placement) or letter size (horizontal placement) will be described. In this case, the control unit 110 controls flushing by the recording heads 17*a* to 17*c* so that ink passes trough the same opening portion groups 82A, 82C, 82F illustrated in FIG. 9 in each cycle of the first conveyor belt 8. A case (second class) where the size of the paper P used is A4 size (vertical placement) or letter size (vertical placement) will be described. In this case, the control unit 110 controls flushing by the recording heads 17*a* to 17*c* so that ink passes trough the same opening portion groups 82A, 82D illustrated in FIG. 10 in each cycle of the first conveyor belt 8. A case (third class) where the size of the paper P used is A3 size, B4 size or legal size (each vertically placed) will be described. In this case, the control unit 110 controls flushing by the recording heads 17*a* to 17*c* so that ink passes trough the same opening portion groups 82A, 82B, 82E illustrated in FIG. 11 in each cycle of the first conveyor belt 8. A case (fourth class) where the size of paper P used is 13 inches×19.2 inches will be described. In this case, the control unit 110 controls flushing by the recording heads 17*a* to 17*c* so that ink passes trough the same opening portion groups 82A, 82D illustrated in FIG. 12 in each cycle of the first conveyor belt 8.

Moreover, the control unit 110 controls the supply of the paper P to the first conveyor belt 8 so as to be shifted in the A direction from the opening portion groups 82 positioned in the determined pattern. In other words, the control unit 110 causes the registration roller pair 13 as a recording medium supply unit to supply the paper P between the plurality of opening portion groups 82 arranged in the A direction in the pattern described above on the first conveyor belt 8.

For example, a case where the paper P used is A4 size (horizontal placement) or letter size (horizontal placement) will be described. In this case, as illustrated in FIG. 9, the control unit 110 controls the registration roller pair 13 to supply the paper P to the first conveyor belt 8 at a specific supply timing so that on the first conveyor belt 8, two sheets of paper P are arranged between the opening portion group 82A and the opening portion group 82C, two sheets of paper P are arranged between the opening portion group 82C and the opening portion group 82F, one sheet of paper P is arranged between the opening group 82F and the opening group 82A. In this case, the control unit 110 controls the registration roller pair 13 to supply paper P to the first conveyor belt 8 so that on the first conveyor belt 8 each sheet of paper P is arranged at a position separated from the opening portion groups 82A, 82C, 82F positioned in the above pattern by a specific distance or more in the A direction (including both upstream and downstream directions). Note that the specific distance above is set to 10 mm as an example here.

Here, the supply timing of the paper P by the registration roller pair 13 can be determined by the control unit 110 based on the detection result of the belt sensor 24 or 25. For example, the belt sensor 24 or 25 detects that a reference opening portion group 82 (for example, the opening portion group 82A) has passed by due to the running of the first conveyor belt 8. Then, the control unit 110 is able to determine how many seconds after the detection time the paper P can be arranged at each position illustrated in FIG. 9 by supplying the paper P to the first conveyor belt 8 by the registration roller pair 13. Therefore, the control unit 110 determines the supply timing of the paper P based on the detection result of the belt sensor 24 or 25, and controls the registration roller pair 13 so that the paper P is supplied at the determined supply timing. As a result, the paper P can be arranged on the first conveyor belt 8 at the respective positions illustrated in FIG. 9 at approximately equal intervals. In the example of FIG. 9, five sheets of paper P can be conveyed in one cycle of the first conveyor belt 8, and 150 ipm (images per minute) can be achieved as the number of printed sheets of paper P per minute (productivity).

Furthermore, as illustrated in FIG. 9, in a case where A4 size (horizontal placement) paper P is supplied to the first conveyor belt 8, only one sheet of paper P is supplied between the opening portion group 82F and the opening portion group 82A of the first conveyor belt 8. In this case, the control unit 110 controls the registration roller pair 13 based on the detection result of the belt sensor 24 or 25, so that the center Po of the paper P in the A direction is located at an intermediate position 8*m* between the opening portion group 82F and the opening portion group 82A. Then, the control unit 110 causes paper P to be supplied from the registration roller pair 13 to the first conveyor belt 8.

On the other hand, a case where the paper P used is A4 size (vertical placement) or letter size (vertical placement) will be described. In this case, as illustrated in FIG. 10, the control unit 110 controls the registration roller pair 13 so that two sheets of paper P are arranged on the first conveyor belt 8 between the opening portion group 82A and the opening portion group 82D, and so that two sheets of paper P are arranged between the opening portion group 82D and the opening portion group 82A. Then, the control unit 110 causes the paper P to be supplied to the first conveyor belt 8 at a specific supply timing. In the example of FIG. 10, four sheets of paper P can be conveyed in one cycle of the first conveyor belt 8, and a productivity of 120 ipm can be achieved.

A case in which the paper P to be used is A3 size, B4 size, or legal size (all vertically place) will be described. In this case, as illustrated in FIG. 11, the control unit 110 controls the registration roller pair 13 to supply the paper P to the first conveyor belt 8 at a specific supply timing so that on the first conveyor belt 8, one sheet of paper P is arranged between the opening portion group 82A and the opening portion group 82B, one sheet of paper P is arranged between the opening portion group 82B and the opening portion group 82E, and one sheet of paper P is arranged between the opening group 82E and the opening group 82A. In the example of FIG. 11, three sheets of paper P can be conveyed in one cycle of the first conveyor belt 8, and a productivity of 90 ipm can be achieved. Note that preferably the control unit 110 causes the paper P to be supplied to the first conveyor belt 8 by controlling the registration roller pair 13 based on the detection result of the belt sensor 24 or 25 so that the center of one sheet of paper P in the A direction is positioned at an intermediate position between two adjacent opening portion groups 82 included in the determined pattern.

A case in which the paper P used has a size of 13 inches×19.2 inches will be described. In this case, as illustrated in FIG. 12, the control unit 110 controls the registration roller pair 13 so that one sheet of paper P is arranged on the first conveyor belt 8 between the opening portion group 82A and the opening portion group 82D, and so that one sheet of paper P is arranged between the opening portion group 82D and the opening portion group 82A. Then, the control unit 110 causes the paper P to be supplied to the first conveyor belt 8 at a specific supply timing. In the example of FIG. 12, two sheets of paper P can be conveyed in one cycle of the first conveyor belt 8, and a productivity of 60 ipm can be achieved.

As described above, the control unit 110 determines the pattern (combination) in the A direction of the plurality of opening portion groups 82 used during flushing according to the size of the paper P used. As a result, regardless of which size paper P is used, it is possible to arrange as many sheets of paper P as possible on the first conveyor belt 8 so as not to overlap the opening portion groups 82 arranged in the above-described patterns. Therefore, regardless of which size of paper P is used, it is possible to avoid a decrease in productivity (a decrease in the number of printed sheets).

Moreover, during one cycle of the first conveyor belt 8, it is possible to perform flushing a plurality of times by using the plurality of opening portion groups 82 positioned in the above-described patterns. Therefore, regardless of which size of paper P used, it is possible to reduce insufficient flushing and clogging of the nozzles (ink ejection ports 18) due to insufficient flushing. In particular, the control unit 110 causes the recording head 17 to execute flushing at a timing when the opening portion group 82 positioned in an above-described pattern faces the recording heads 17*a* to 17*c* due to running of the first conveyor belt 8. Accordingly, flushing may be reliably performed a plurality of times during one cycle of the first conveyor belt 8 and insufficient flushing may be eliminated.

Moreover, it is not necessary to reduce the conveying speed of the paper P as in a conventional case in order to eliminate insufficient flushing, so it is possible to contribute to the improvement of productivity from this aspect as well. In addition, it is not necessary to change the conveying speed of the paper P, so complicated control for conveying the paper P (complicated drive control of the first conveyor belt 8) is also unnecessary.

Furthermore, in the present embodiment, the storage unit 28 stores the information about the size of the paper P that is inputted using the operation panel 27 in advance, or in other words, the information about the size of the paper P conveyed by the first conveyor belt 8. Then, the control unit 110 recognizes the size of the paper P to be used based on the information stored in the storage unit 28, and determines the pattern of the opening portion groups 82 according to the recognized size. For example, the printer 100 may include a sensor that detects the size of the paper P to be used, and the control unit 110 may determine the pattern of the opening portion groups 82 according to the size detected by the sensor; and in this case, a dedicated sensor for detecting the size of the paper P is required. In the present embodiment, the control unit 110 recognizes the size of the paper P based on the information stored in the storage unit 28 and determines the pattern, so the effect of this embodiment can be obtained by determining the pattern without separately providing a dedicated sensor for detecting the size of the paper P.

Moreover, the control unit 110 causes the paper P to be supplied from the registration roller pair 13 between the plurality of opening portion groups 82 arranged in the above-described pattern on the first conveyor belt 8. As a result, even if ink that is ejected from the recording heads 17*a* to 17*c* adheres to the opening portions 80 of the opening portion groups 82 during flushing and the opening portions 80 become stained, the paper P is not conveyed overlapping the dirty opening portions 80. In this way, it is possible to reduce situations in which the paper P becomes stained due to the ink staining of the opening portions 80.

In addition, on the first conveyor belt 8, the paper P is positioned away from the opening portion groups 82 in the A direction by a specific distance (for example, 10 mm) or more. This makes it possible to deal with the following situations. For example, there are cases where the ink ejected from the recording heads 17*a* to 17*c* at the time of flushing deviates in the direction A from the path toward the opening portion groups 82 for some reason and proceeds. One of the reasons for this may be for example, the effect of negative pressure suction of the paper P. Then, even in a case where the ink collides with the surroundings of the opening portions 80 of the opening portion groups 82 and is scattered around, or in other words, even in a case where splashing occurs, the scattered ink does not easily reach the paper P. Therefore, it is possible to reduce the situation in which the paper P is stained due to the ink splashing during flushing. Note that the specific distance may be appropriately set according to the viscosity of the ink, the suction force on the paper P (the driving force of the suction members 53 described above), the running speed of the first conveyor belt 8 (conveying speed of the paper P), and the like. In other words, the specific distance is not limited to the 10 mm as described above.

Furthermore, in the present embodiment, the control unit 110, based on the detection result of the belt sensor 24 or 25, determines the timing for supplying paper P to positions between the plurality of opening portion groups 82 on the first conveyor belt 8 (positions apart from the opening portion groups 82 by a specific distance or more in the A direction). Then, the control unit 110 causes the paper P to be supplied from the registration roller pair 13 to the first conveyor belt 8 at the determined timing. As a result, the registration roller pair 13 is able to reliably supply paper P to the above-mentioned positions between an opening portion group 82 and the opening portion group 82 of the first conveyor belt 8 to surely obtain the effect described above.

In addition, in the present embodiment, as described above, the control unit 110 controls the flushing in the recording heads 17*a* to 17*c* based on the detection result of the belt sensor 24 or 25 so that ink passes through the same opening portion groups 82 in each cycle of the first conveyor belt 8 for each class determined according to the size of the paper P. In this case, in each cycle of the first conveyor belt 8, the other opening portion groups 82 are not stained with ink during flushing. Therefore, regardless of the class of paper P, in each cycle of the first conveyor belt 8, such a conveyance of paper P is possible with no concern that the paper P will be stained even though conveyed so as to overlap another opening portion group 82. In other words, regardless of the class of paper P, in each cycle, it is possible convey the paper P without being stained by arranging the paper P so as to avoid the opening portion group 82 through which ink passes during flushing.

Moreover, in this embodiment, as illustrated in FIG. 9, a case where one sheet of paper P is supplied from the registration roller pair 13 between the opening portion group 82F and the opening portion group 82A that are adjacent to each other in the A direction is considered. In this case, the control unit 110 causes the paper P to be supplied from the registration roller pair 13 to the first conveyor belt 8 so that the center Po of the paper P in the A direction is positioned at an intermediate position 8*m* between two adjacent opening portion groups 82F and 82A of the first conveyor belt 8. At this time, the control unit 110 controls the registration roller pair 13 based on the detection result of the belt sensor 24 or 25.

In this case, both the front end (the end portion on the downstream side in the A direction) and the rear end (the end portion on the upstream side in the A direction) of the paper P are separated by the same distance from the opening portion group 82F located on the downstream side and the opening portion group 82A located on the upstream side with respect to the paper P on the first conveyor belt 8. This makes it possible to deal with the following situations. In other words, this is a situation in which the ink ejected from the recording heads 17*a* to 17*c* at the time of flushing and deviating from the path toward the one opening portion group 82F or the other opening portion group 82A collides with the surroundings of the opening portions 80 and is scattered, or in other words, splashing occurs. Even in this case, the scattered ink is less likely to reach the front end and the rear end of the paper P. Therefore, it is possible to reliably reduce situations where the paper P is stained due to splashing of ink.

Moreover, in the present embodiment, as illustrated in FIGS. 9 to 12, the control unit 110 causes the paper P to be supplied from the registration roller pair 13 to the first conveyor belt 8 at regular intervals. In this case, the supply of paper P from the registration roller pair 13 to the first conveyor belt 8 may be controlled at a constant timing, so the supply control of paper P (control of the registration roller pair 13) becomes easy.

In addition, in the present embodiment, the first conveyor belt 8 further has suction holes 8*a* in addition to the opening portions 80 described above. In addition, in the first conveyor belt 8, the size (opening area) of the opening portions 80 is larger than the size (opening area) of the suction holes 8*a*. For example, in a case where the suction holes 8*a* are large, the ink ejected from the recording heads 17*a* to 17*c* during flushing may deviate from the direction toward the opening portion 80 toward the suction holes 8*a* and collide with the surroundings of the opening portions 80 and cause splashing, which is a concern. By making the suction holes 8*a* relatively smaller than the opening portions 80, it is possible to further reduce the occurrence of the above-mentioned splashing and further reduce the staining of the paper P due to splashing.

Moreover, the opening portion groups 82 of the first conveyor belt 8 are irregularly positioned in the A direction in one cycle of the first conveyor belt 8. In this case, the effects of the present embodiment described above may be obtained by using the first conveyor belt 8 in which the minimum necessary opening portion groups 82 that can accommodate the sizes of the plurality of sheets of paper P are arranged in the A direction. Furthermore, by suppressing the number of the opening portion groups 82 to the necessary minimum, the strength of the first conveyor belt 8 can be easily maintained.

In addition, as illustrated in FIG. 9, the A4 size (horizontal placement) and the letter size (horizontal placement) belong to the same class (first class). Then, in this class, the opening group portions 82 used for flushing are in a fixed pattern of the opening portion groups 82A, 82C, 82F. In addition, as illustrated in FIG. 10, the A4 size (vertical placement) and the letter size (vertical placement) belong to the same class (second class). Then, in this class, the opening group portions 82 used for flushing are in a fixed pattern of the opening portion groups 82A and 82D. In addition, as illustrated in FIG. 11, the A3 size, the B4 size, and the legal size (all vertically placed) belong to the same class (third class). Then, in this class, the opening group portions 82 used for flushing are in a fixed pattern of the opening portion groups 82A, 82B and 82E. Furthermore, as illustrated in FIG. 12, the size of 13 inches×19.2 inches independently constitutes one class (fourth class). Then, in this class, the opening group portions 82 used for flushing are in a fixed pattern of the opening portion groups 82A and 82D.

As described above, the pattern of the opening portion groups 82 used during flushing is a fixed pattern for each class determined according to the size of the paper P. In this case, the control unit 110 may perform the ejection control of ink in the recording heads 17*a* to 17*c* for each class in a pattern corresponding to the pattern of the opening portion groups 82 during flushing, and thus the ejection control is easy.

Moreover, the patterns of the opening portion groups 82 used during flushing are different from each other in FIGS. 9 and 10, FIGS. 10 and 11, and FIGS. 11 and 12. On the other hand, the above patterns are the same in FIG. 10 and FIG. 12. From this, it can be said that the patterns differ between at least two classes determined according to the size of the paper P. With such a pattern setting, flushing can be executed on any size (class) of paper P by using the opening portion groups 82 having an appropriate pattern without lowering productivity.

In addition, in the first conveyor belt 8, the opening portion groups 82 have a plurality of opening portion rows 81 in the A direction. The opening portions 80 of any one of the opening portion rows 81 (for example, the opening portions 81*a*) is shifted from the opening portions 80 of the other opening row 81 (for example, the opening portion row 81*b*) in the belt width direction, and is located so as to overlap with part of the opening portions 80 of the other opening portion row 81 when viewed in the A direction. In this case, the nozzles (ink ejection ports 18) at any position in the width direction of the recording heads 17*a* to 17*c* eject ink from the nozzles, and flushing can be performed by passing the ink through the opening portions 80 at any position in the belt width direction of the first conveyor belt 8. Therefore, it is possible to reduce or prevent nozzle clogging for nozzles at all positions in the width direction.

Furthermore, in the first conveyor belt 8, the plurality of opening portions 80 of the opening portion rows 81 are located at equal intervals in the belt width direction. With this configuration, by arranging the plurality of opening portion rows 81 so as to be shifted in the belt width direction, it becomes easy to partially overlap the opening portions 80 of the adjacent opening portion rows 81 when viewed in the A direction. Therefore, it becomes easy to manufacture the first conveyor belt 8 having such a configuration.

Moreover, in the present embodiment, the first conveyor belt 8 has six opening portion groups 82 in the A direction in one cycle. In this case, for the four classes classified according to the size of the paper P, it is possible to generate a pattern in the A direction of the opening portion groups 82 without lowering the productivity. Note that the first conveyor belt 8 may have seven or more opening portion groups 82 in the A direction in one cycle. In this case, it is possible to generate a pattern in the A direction of the opening portion groups 82 that does not reduce the productivity for five or more classes classified according to the size of the paper P.

(3-3. Other Configuration Example of the First Conveyor Belt)

Figure 13:
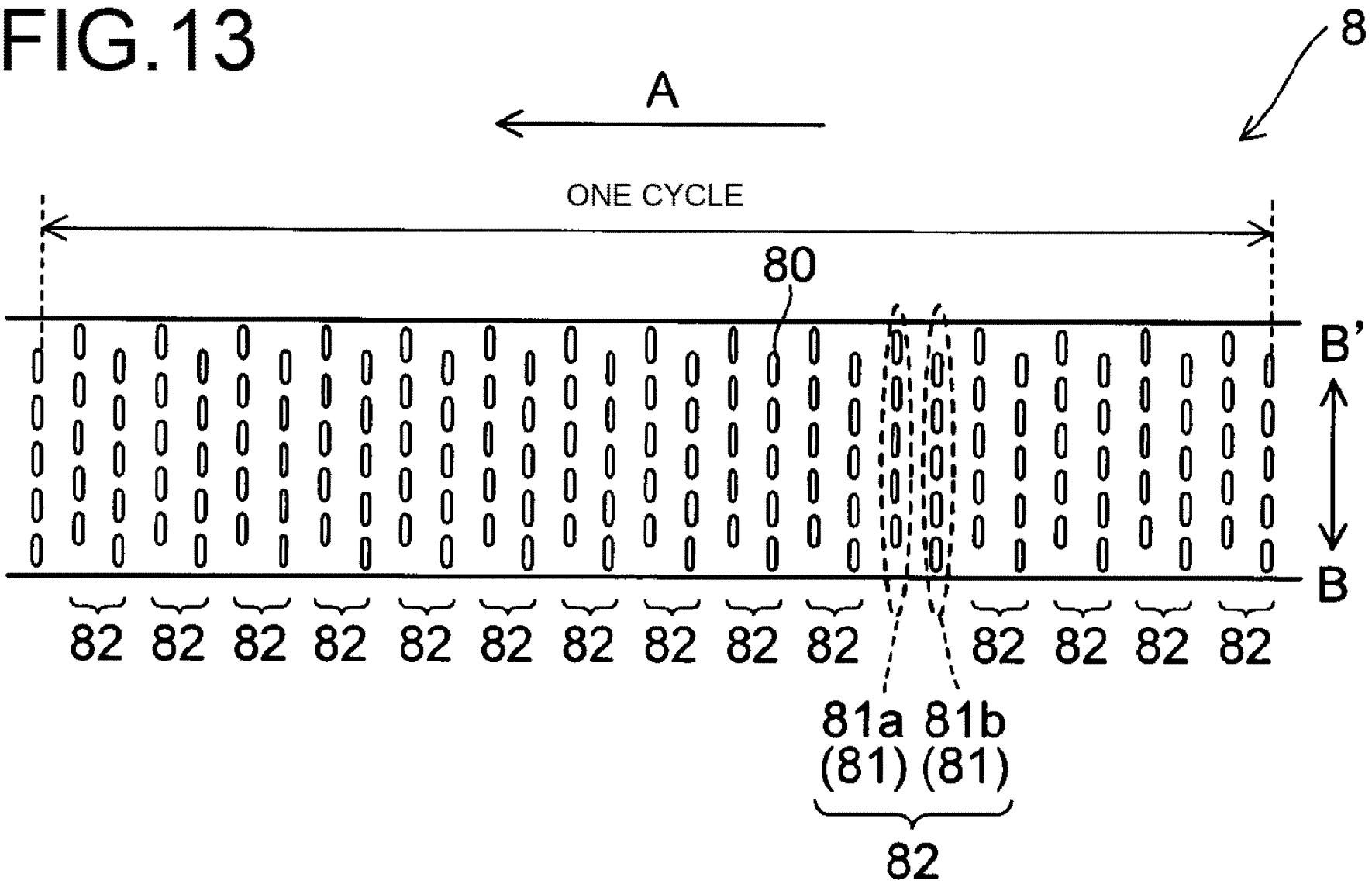
FIG. 13 is a plan view illustrating another configuration example of the first conveyor belt.

FIG. 13 is a plan view illustrating another configuration example of the first conveyor belt 8. The first conveyor belt 8 may have a configuration in which the opening portion groups 82 described above are located at equal intervals in the conveying direction of the first conveyor belt 8, or in other words, the A direction. In this case, two opening portion groups 82 adjacent to each other in the A direction are arranged at intervals shorter than the length of the paper P in the A direction when the smallest printable size of the paper P is placed on the first conveyor belt 8. In addition, in the configuration of FIG. 13, the opening portions 80 that constitute the opening portion groups 82 also serve as suction holes 8*a* in the configuration of FIG. 8. Note that the opening portion groups 82 have a plurality of opening portion rows 81, and one opening portion row 81 has a plurality of opening portions 80 arranged at equal intervals in the BB' direction, or in other words, is the same as the first conveyor belt 8 described in FIG. 8 and the like.

Figure 14:
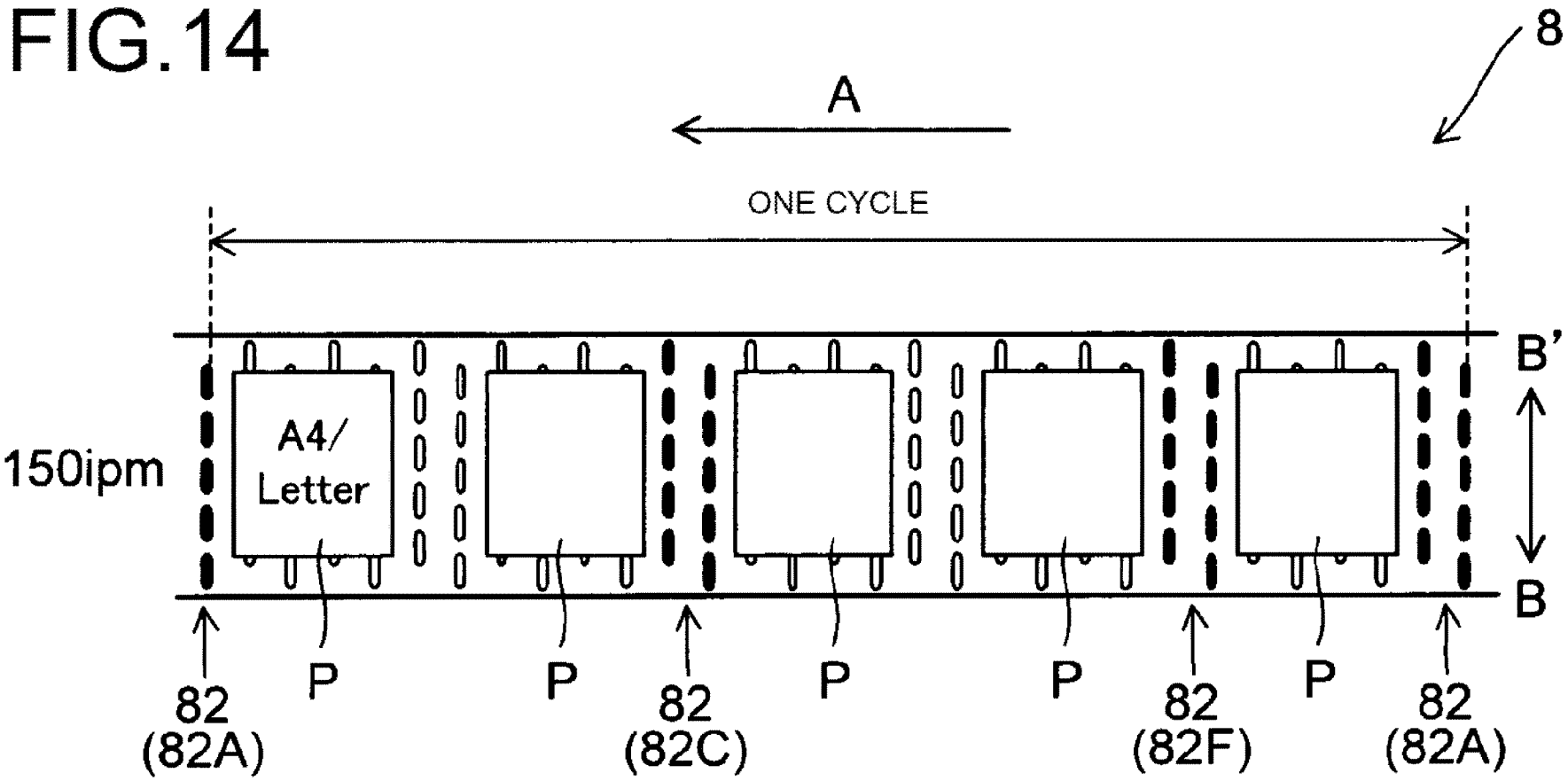
FIG. 14 is an explanatory diagram schematically showing an example of the pattern when the first conveyor belt of FIG. 13 is used and paper arranged on the first conveyor belt according to the pattern.
Figure 15:
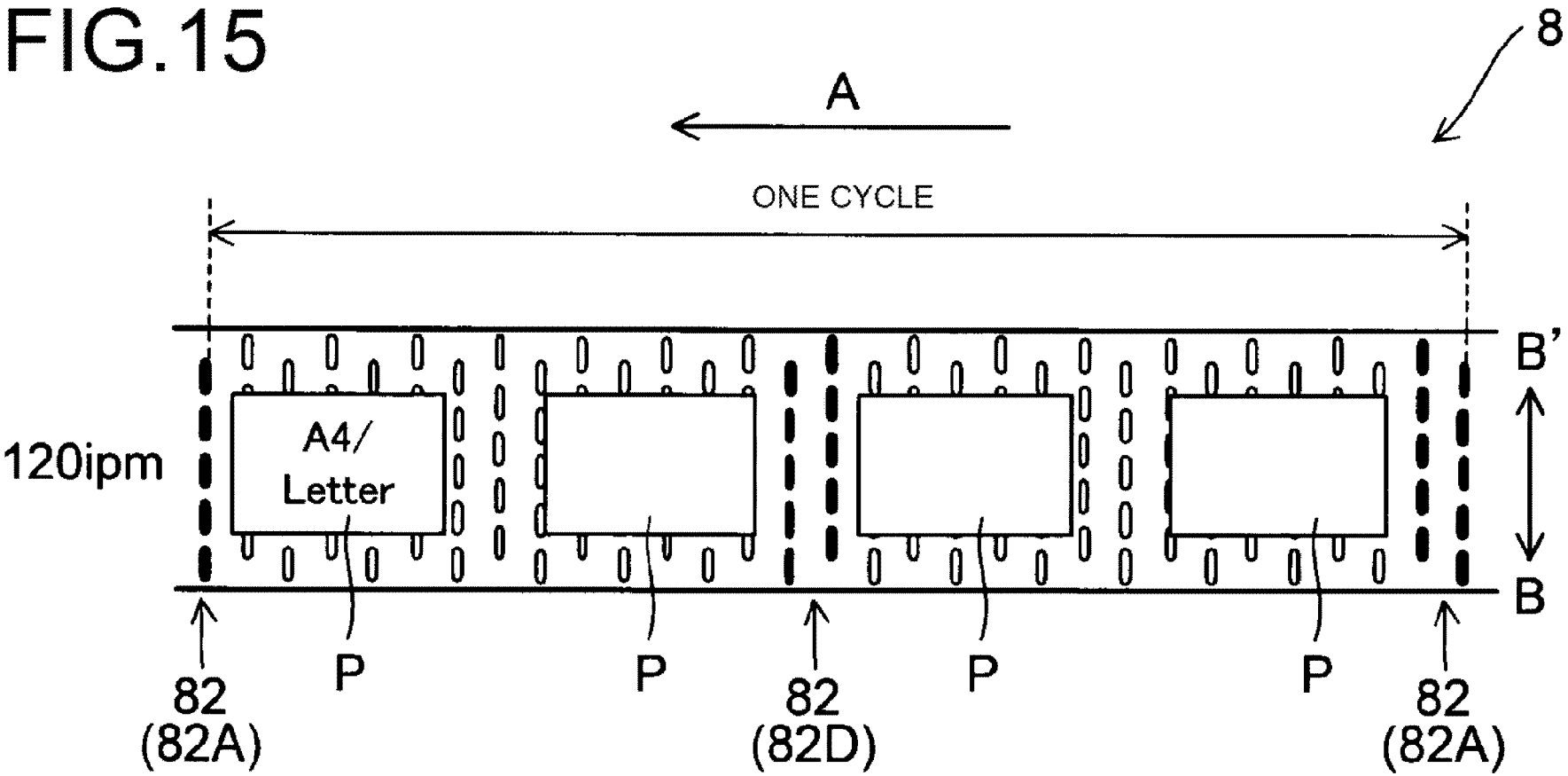
FIG. 15 is an explanatory diagram schematically illustrating another example of the pattern and paper arranged on the first conveyor belt according to the pattern.
Figure 16:
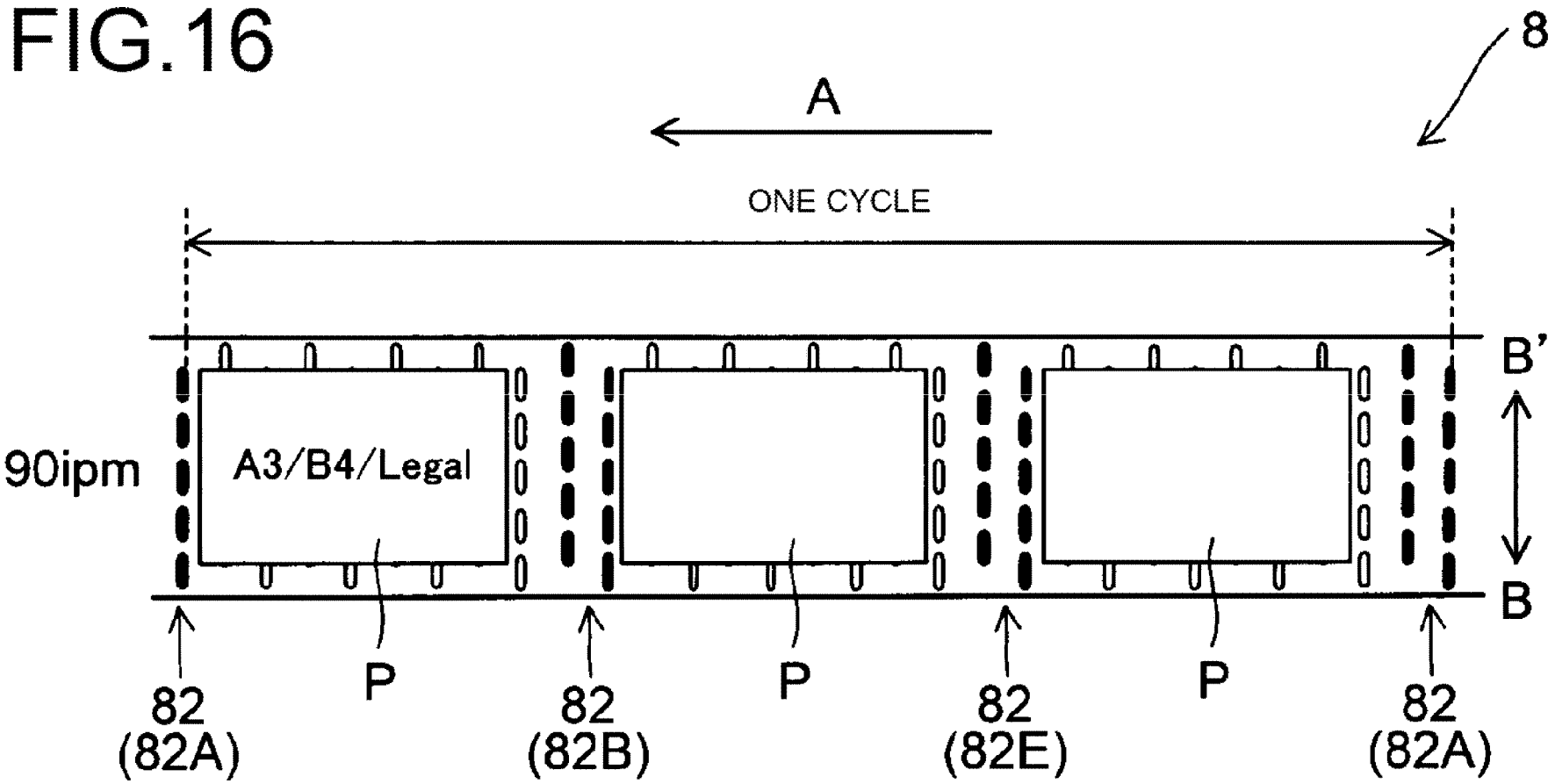
FIG. 16 is an explanatory diagram schematically illustrating yet another example of the pattern and paper arranged on the first conveyor belt according to the pattern.
Figure 17:
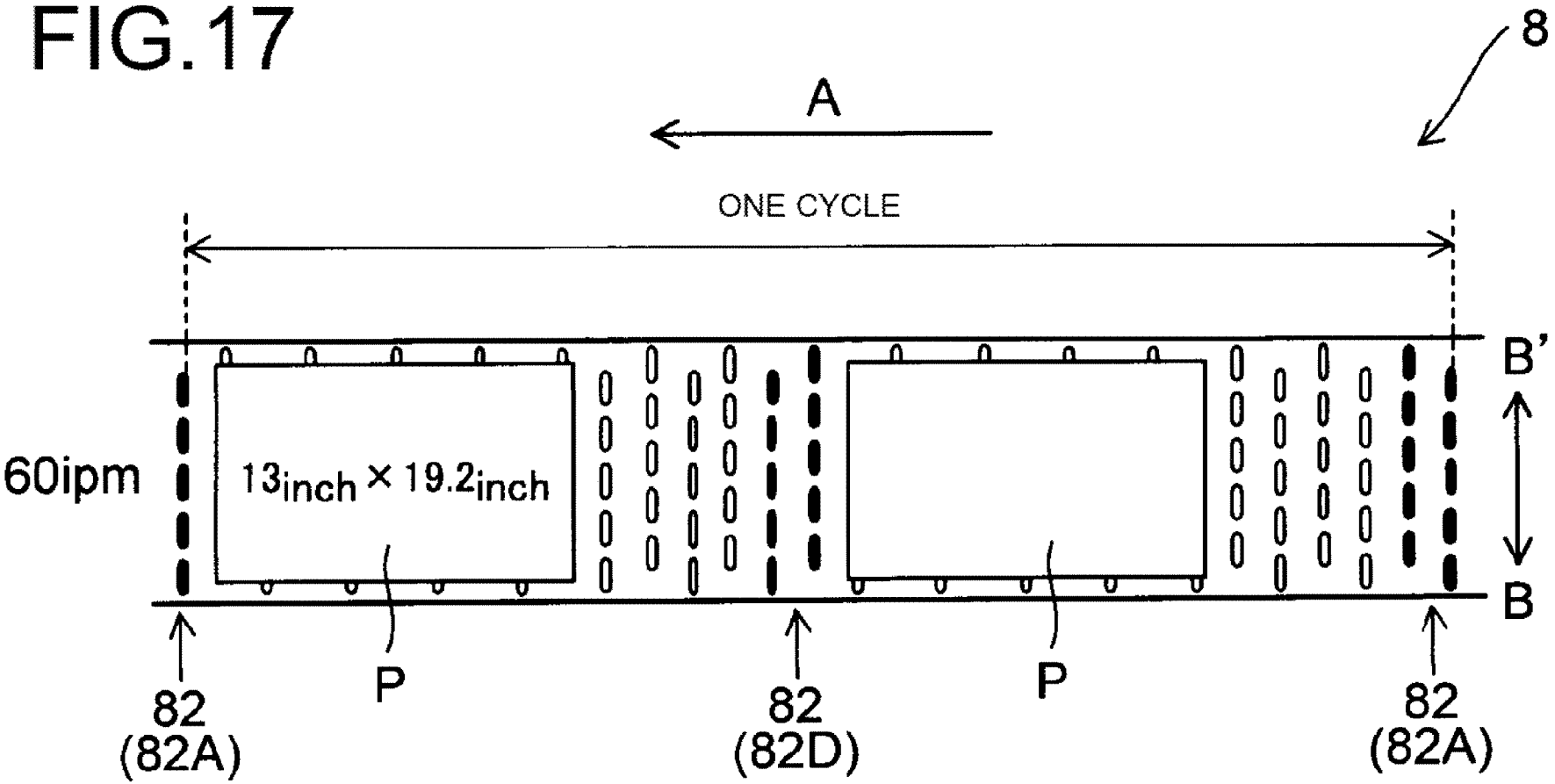
FIG. 17 is an explanatory diagram schematically illustrating yet another example of the pattern and paper arranged on the first conveyor belt according to the pattern.

Even in a case where the first conveyor belt 8 illustrated in FIG. 13 is used, the control unit 110, as in the case of using the first conveyor belt 8 illustrated in FIG. 8, determines a pattern of the plurality of opening portion groups 82 in the A direction that will be used according to the size of the paper P to be used. For example, in a case where the paper P to be used is A4 size (horizontal placement) or letter size (horizontal placement), the control unit 110 selects the pattern of the opening portion groups 82 illustrated in FIG. 14. In a case where the paper P to be used is A4 size (vertical placement) or letter size (vertical placement), the control unit 110 selects the pattern of the opening portion groups 82 illustrated in FIG. 15. In a case where the paper P to be used is A3 size, B4 size, or legal size (each vertically placed), the control unit 110 selects the pattern of the opening portion groups 82 illustrated in FIG. 16. In a case where the paper P to be used has a size of 13 inches×19.2 inches, the control unit 110 selects the pattern of the opening portion groups 82 illustrated in FIG. 17. Note that, in FIGS. 14 to 17, for convenience, the opening portion groups 82 in positions corresponding to the opening portion groups 82A to 82F in FIG. 8 are illustrated as the opening portion groups 82A to 82F.

Then, the control unit 110, by the running of the first conveyor belt 8, causes the recording heads 17*a* to 17*c* to execute flushing at the timing when the opening portion groups 82 positioned in the determined pattern face the recording heads 17*a* to 17*c*.

In addition, the control unit 110 causes the registration roller pair 13 to supply the paper P to the position illustrated in FIGS. 14 to 17 on the first conveyor belt 8 (between the plurality of opening portion groups 82 arranged in the direction A in the above pattern). At this time, the control unit 110 controls the registration roller pair 13 so that each sheet of paper P is arranged on the first conveyor belt 8 at a position separated from the opening portion groups 82 positioned in the above pattern by a specific distance or more in the direction A (including both the upstream side and the downstream side). Then, the control unit 110 causes the paper P to be supplied to the first conveyor belt 8.

As described above, even in a case where the first conveyor belt 8 illustrated in FIG. 13 is used, the control unit 110 performs the same control (flushing control, paper P supply control) as that when the first conveyor belt 8 illustrated in FIG. 8 is used. As a result, regardless of the size of the paper P used, it is possible to obtain the same effects as described above, such being able to reduce clogging or the like of nozzles due to insufficient flushing, being able to reduce staining of the paper due to splashing, and the like while avoiding a decrease in productivity.

In particular, a configuration in which the opening portion groups 82 are located at equal intervals in the A direction of the first conveyor belt 8 can be easily achieved by forming holes in the first conveyor belt 8 at constant intervals in the A direction. Therefore, manufacturing the first conveyor belt 8 is simplified, and the manufacturing cost thereof can be reduced.

In addition, in a configuration in which the opening portions 80 of the first conveyor belt 8 also have the function of the suction holes 8*a* illustrated in FIG. 8, the opening area of the opening portions 80 is equal to the opening area of the suction holes 8*a* and only one type of hole size needs to be formed in the first conveyor belt 8. From this aspect as well, manufacturing of the first conveyor belt 8 is easier than in the case of the configuration of FIG. 8 in which two different types of hole sizes are formed.

Note that in a configuration in which the paper P is conveyed by the first conveyor belt 8 by the negative pressure suction method, in order to obtain the effect of reducing clogging or the like of the nozzles due to insufficient flushing while avoiding the decrease in productivity, the first conveyor belt 8 may have the configuration illustrated in FIG. 8 or the configuration illustrated in FIG. 13. Therefore, in summarizing the configurations of FIGS. 8 and 13, it can be said that in the first conveyor belt 8, the size of the opening portions 80 may be equal to or larger than the size of the suction holes 8*a*.

Note that in the first conveyor belt 8 configured as illustrated in FIG. 13, innumerable opening portions 80 for flushing are formed over the entire surface of the belt. Therefore, the paper P can be packed and conveyed in the A direction on the first conveyor belt 8, and by performing flushing using the opening portions 80 at a position not overlapped by the paper P, it is possible to significantly improve productivity However, when the paper P is conveyed in such a manner, the opening portions 80, which become stained due to the passage of ink during flushing, and the paper P to be conveyed are likely to overlap with each other in each cycle of the first conveyor belt 8, making it easier for the paper P to become stained.

Even with a configuration using the first conveyor belt 8 in FIG. 13, as described above, the pattern of the opening portion groups 82 used at the time of flushing is determined according to the size of the paper P, and flushing is performed using the opening portion groups 82 positioned in the determined pattern. As a result, together with being able to perform flushing using the same opening portion groups 82 in each cycle, the paper P can be arranged and conveyed at positions shifted from the opening portion groups 82 used for flushing. Accordingly, it is possible to reduce stains on the paper P when the paper P is conveyed and printed over a plurality of cycles while at the same time maintain productivity. In this respect, the flushing control and the paper P supply control described in the present embodiment are effective even when the first conveyor belt 8 having the configuration of FIG. 13 is used.

Note that in a case where the paper P is conveyed by the first conveyor belt 8 illustrated in FIG. 13, the pattern of the opening portion groups 82 used during flushing may be a different pattern than the pattern used in a case where the first conveyor belt 8 illustrated in FIG. 8 is used. For example, the flushing may be performed on the opening portion groups located between the paper P and the paper P conveyed at the positions illustrated in FIGS. 14 to 17.

In the description above, a case is explained in which the paper P is sucked to the first conveyor belt 8 by negative pressure and conveyed, however, the first conveyor belt 8 may be electrically charged and the paper P may be electrostatically sucked to the first conveyor belt 8 and conveyed (electrostatic attraction method). Even in this case, the same effect as that of the present embodiment may be obtained by performing flushing control and supply control of the paper P to the first conveyor belt 8 in a manner similar to the present embodiment.

In the description above, an example is described in which a color printer that records a color image using four colors of ink is used as the inkjet recording apparatus. However, the control described in the present embodiment may be applied even in a case where a monochrome printer that records a monochrome image using black ink is used.

In the configuration of a typical technique, the number of times of flushing in the same recording head is once in one cycle of the conveyor belt regardless of the size of the recording medium used, and the frequency of flushing is low. Therefore, regardless of the size of the recording medium used, insufficient flushing is likely to occur, and a reduction in nozzle clogging due to flushing is insufficient. Moreover, in a configuration in which the conveying speed of the recording medium is slowed in order to eliminate insufficient flushing as in a typical technique, the reduction in the conveying speed reduces the number of recording media conveyed in one cycle of the conveyor belt, so the number of printed recording medium, or in other words, the productivity is reduced. On the other hand, in a typical technique, the productivity of the recording medium is not studied at all.

Moreover, when the ink ejected at the time of flushing adheres to the opening portions of the conveyor belt and the opening portions become stained, in a case where the recording medium is conveyed while overlapping those opening portions, the stain of the opening portions will be transferred to the recording medium and the recording medium will become stained. Therefore, in a configuration in which flushing is performed, it is also necessary to reduce staining of the recording medium due to this kind of staining of the opening portions.

Furthermore, the recording medium is placed on the conveyor belt and conveyed, for example, by negative pressure suction or electrostatic attraction. In this case, due to the influence of the suction force or the electrostatic force, the ink ejected from the recording head at the time of flushing may deviate in the conveying direction from the path toward the opening portions of the conveyor belt and progress. In this case, there is a risk that the ink will collide with the surroundings of the opening portions and be scattered to the surroundings, or in other words, splashing may occur, and the scattered ink may adhere to the recording medium and stain the recording medium. Therefore, it is also necessary to reduce the staining of the recording medium due to splashing of the ink.

The inkjet recording apparatus, regardless of the size of the recording medium used, it is possible to reduce the clogging of the nozzles due to insufficient flushing while avoiding a decrease in productivity of the recording medium. Together with this, it is possible to reduce situations in which the recording medium is stained due to staining of the opening portions with the ink ejected during flushing. It is also possible to reduce situations in which the recording medium is stained due to the direct adhering of ink.

The technique according to the present disclosure can be used for an inkjet recording apparatus that records an image by ejecting ink onto a recording medium.

It should be noted that it is needless to say that the configurations and operations of the above-described embodiments are merely examples, and may be appropriately modified and implemented without departing from the spirit of the present invention.

What is claimed is:

1. An inkjet recording apparatus comprising:

a recording head having a plurality of nozzles for ejecting ink; and an endless conveyor belt for conveying a recording medium to a position facing the recording head; and further comprising:

a recording medium supply unit for supplying the recording medium to the conveyor belt; and a control unit that together with causing the recording head to perform flushing for ejecting the ink at a timing different from timing that contributes to image formation on the recording medium, controls supply of the recording medium to the conveyor belt by the recording medium supply unit; wherein the conveyor belt has a plurality of opening portion groups in a conveying direction of the recording medium in which opening portions for allowing ink ejected from each of the nozzles of the recording head to pass during the flushing are arranged in a belt width direction perpendicular to the conveying direction of the recording medium;

the control unit determines a pattern of the plurality of opening portion groups used in the flushing in one cycle of the conveyor belt according to a size of the recording medium, and causes the recording medium to be supplied from the recording medium supply unit between the plurality of opening portion groups arranged in the conveying direction in the pattern on the conveyor belt and at positions more than a certain distance from the opening portion groups;

the inkjet recording apparatus further comprises a detection sensor for detecting the passage of at least one of the opening portion groups due to running of the conveyor belt;

the control unit determines a timing for supplying the recording medium at the positions between the plurality of opening portions on the conveyor belt based on a detection result of the detection sensor, and causes the recording medium to be supplied from the recording medium supply unit to the conveyor belt at the determined timing; and the control unit, when one sheet of the recording medium is supplied on the conveyor belt between two of the opening portion groups that are adjacent to each other in the conveying direction in the pattern, causes the recording medium to be supplied to the conveyor belt from the recording medium supply unit so that a center of the recording medium in the conveying direction is located at an intermediate position between two adjacent opening portion groups.

2. The inkjet recording apparatus according to claim 1 further comprising a storage unit for storing size information about the recording medium conveyed by the conveyor belt; wherein the control unit recognizes a size of the recording medium based on the information stored in the storage unit, and determines the pattern according to the recognized size.

3. The inkjet recording apparatus according to claim 1, wherein the control unit, based on the detection result of the detection sensor, controls the flushing in the recording head so that the ink passes through the same opening portion groups positioned in the pattern in each cycle of the conveyor belt for each class determined according to the size of the recording medium.

4. The inkjet recording apparatus according to claim 1, wherein the control unit causes the recording medium to be supplied to the conveyor belt from the recording medium supply unit at a fixed interval.

5. The inkjet recording apparatus according to claim 1 further comprising a suction member for sucking the recording medium onto the conveyor belt by negative pressure suction, wherein the conveyor belt further has suction holes for passing suction air generated by the negative pressure suction, and in the conveyor belt, the size of the opening portions is equal to or larger than the size of the suction holes.

6. The inkjet recording apparatus according to claim 1, wherein the control unit causes the recording head to execute the flushing at a timing at which the opening portion groups positioned in the pattern face the recording head due to running of the conveyor belt.

7. The inkjet recording apparatus according to claim 1, wherein the opening portion groups are irregularly positioned in the conveying direction in one cycle of the conveyor belt.

8. The inkjet recording apparatus according to claim 1, wherein the opening portion groups are positioned at equal intervals in the conveying direction of the conveyor belt.

9. The inkjet recording apparatus according to claim 1, wherein the pattern is a fixed pattern for each class determined according to the size of the recording medium.

10. The inkjet recording apparatus according to claim 1, wherein the pattern differs between at least two classes that are determined depending on the size of the recording medium.

11. The inkjet recording apparatus according to claim 1, wherein the opening portion group is configured to have a plurality of opening portion rows in the conveying direction in which a plurality of the opening portions are arranged in the belt width direction perpendicular to the conveying direction; and in the opening portion groups, the opening portions of any one of the opening portion rows are positioned to be shifted in the belt width direction from the opening portions of the other opening portion rows, and positioned so as to overlap with a part of the opening portions of the other opening portion rows when viewed in the conveying direction.

12. The inkjet recording apparatus according to claim 11, wherein in the conveyor belt, the plurality of opening portions in the opening portion rows are located at equal intervals in the belt width direction.

* * * * *